US010795319B2

(12) United States Patent
Hasegawa

(10) Patent No.: US 10,795,319 B2
(45) Date of Patent: Oct. 6, 2020

(54) DEVICE, ELECTRONIC TIMEPIECE, AND STORAGE DEVICE

(71) Applicant: CASIO COMPUTER CO., LTD., Tokyo (JP)

(72) Inventor: Kosuke Hasegawa, Koganei (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 177 days.

(21) Appl. No.: 15/848,830

(22) Filed: Dec. 20, 2017

(65) Prior Publication Data

US 2018/0173168 A1 Jun. 21, 2018

(30) Foreign Application Priority Data

Dec. 21, 2016 (JP) ..... 2016-247364

(51) Int. Cl.

| | |
|---|---|
| ***G04G 5/00*** | (2013.01) |
| ***G04G 9/00*** | (2006.01) |
| ***G04G 21/04*** | (2013.01) |
| ***G04G 7/00*** | (2006.01) |
| ***G04R 20/26*** | (2013.01) |
| ***G04R 20/02*** | (2013.01) |

(52) U.S. Cl.

CPC ..... *G04G 5/002* (2013.01); *G04G 7/02* (2013.01); *G04G 9/0076* (2013.01); *G04G 21/04* (2013.01); *G04R 20/02* (2013.01); *G04R 20/26* (2013.01)

(58) Field of Classification Search

CPC ..... G04R 20/00

See application file for complete search history.

(56) References Cited

U.S. PATENT DOCUMENTS

| | | | | |
|---|---|---|---|---|
| 9,354,612 | B1 * | 5/2016 | King | G04G 7/00 |
| 2007/0140064 | A1 * | 6/2007 | Fujisawa | G04R 20/10 368/47 |
| 2010/0054087 | A1 * | 3/2010 | Matsuzaki | G04R 20/04 368/14 |
| 2012/0176868 | A1 * | 7/2012 | Matsuzaki | G04R 20/04 368/47 |

(Continued)

FOREIGN PATENT DOCUMENTS

| | | | |
|---|---|---|---|
| CN | 1470963 | A | 1/2004 |
| CN | 101340665 | A | 1/2009 |

(Continued)

OTHER PUBLICATIONS

Notification of Reasons for Refusal dated Nov. 20, 2018 received in Japanese Patent Application No. JP 2016-247364 together with an English language translation.

(Continued)

*Primary Examiner* — Edwin A. Leon
*Assistant Examiner* — Jason M Collins
(74) *Attorney, Agent, or Firm* — Scully Scott Murphy & Presser

(57) ABSTRACT

A device having one or more processors, the one or more processors configured to acquire time information by performing one or more of a first acquisition operation to control a communicator to communicate with an external device to receive signals including the time information, and a second acquisition operation to control one or more radio wave receivers to receive transmission radio waves with signals including the time information.

21 Claims, 11 Drawing Sheets

(56) References Cited

U.S. PATENT DOCUMENTS

| | | | | |
|---|---|---|---|---|
| 2014/0192626 | A1 | 7/2014 | Wolff et al. | |
| 2015/0277387 | A1* | 10/2015 | Hasegawa | G04G 9/00 368/239 |
| 2016/0061960 | A1* | 3/2016 | Matsue | G04R 20/04 368/47 |

FOREIGN PATENT DOCUMENTS

| | | | |
|---|---|---|---|
| CN | 102156403 | A | 8/2011 |
| EP | 1 801 674 | A1 | 6/2007 |
| EP | 2 161 633 | A2 | 3/2010 |
| JP | 2008-051697 | A | 3/2008 |
| JP | 2011-112472 | A | 6/2011 |
| JP | 2011-252742 | A | 12/2011 |
| JP | 2015-010924 | A | 1/2015 |
| JP | 2015-068795 | A | 4/2015 |

OTHER PUBLICATIONS

Extended European Search Report dated Jul. 3, 2018 received in European Patent Application No. EP 17208902.1.

Office Action dated Aug. 22, 2019 received in Chinese Patent Application No. CN 201711385888.5 together with an English language translation.

Second Office Action dated Jan. 15, 2020 received in Chinese Patent Application No. CN 201711385888.5 together with an English language translation.

* cited by examiner (CONT.)

(FIG. 3 CONTINUED)
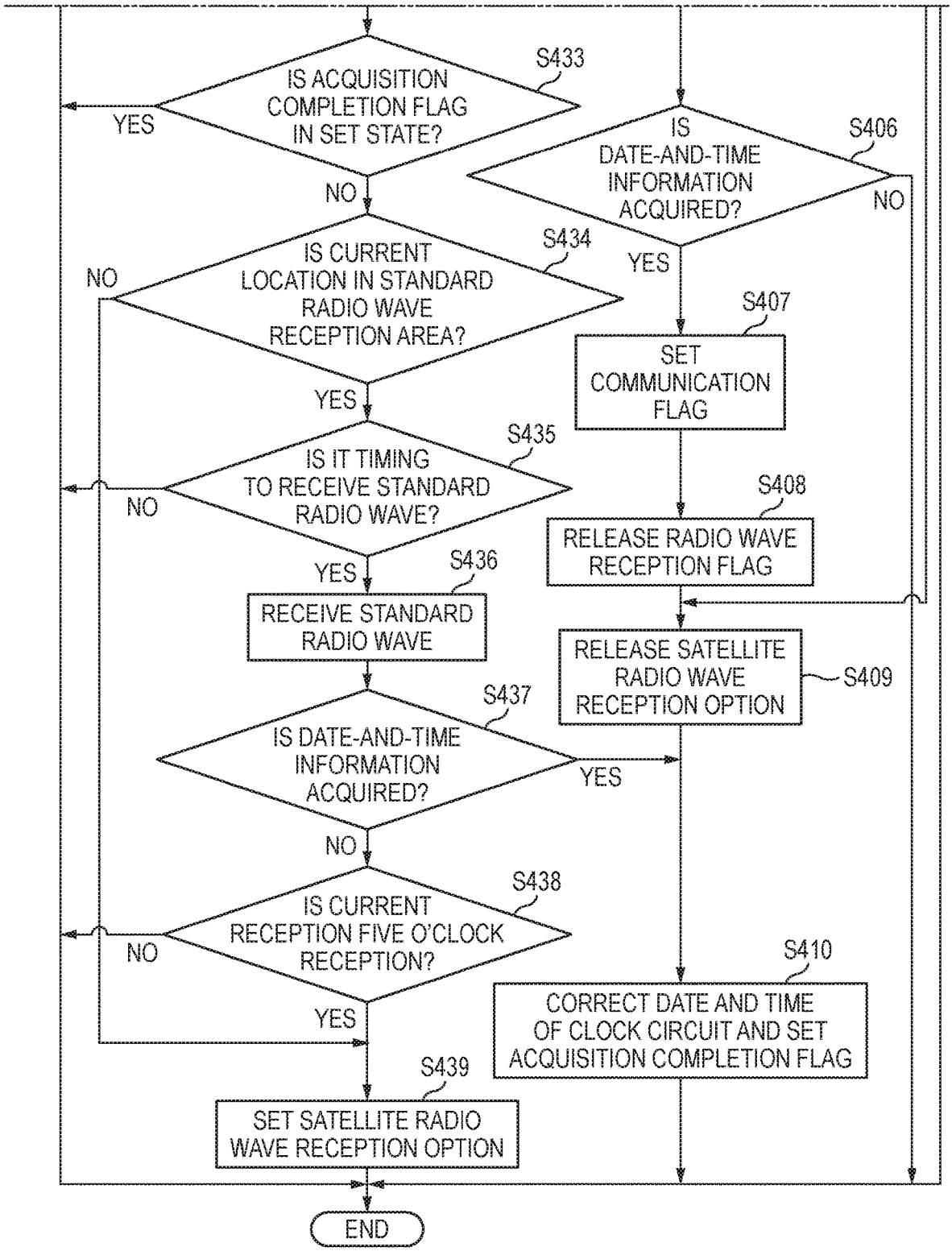

(FIG. 4 CONTINUED)
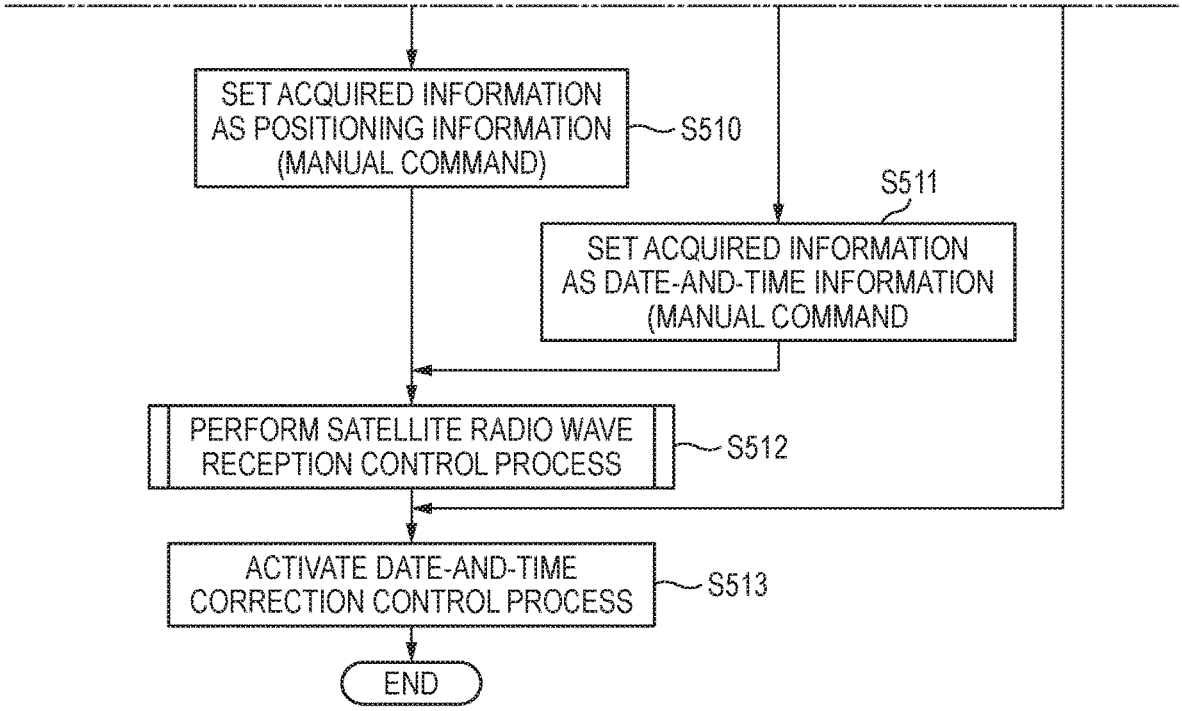

(FIG. 8 CONTINUED)
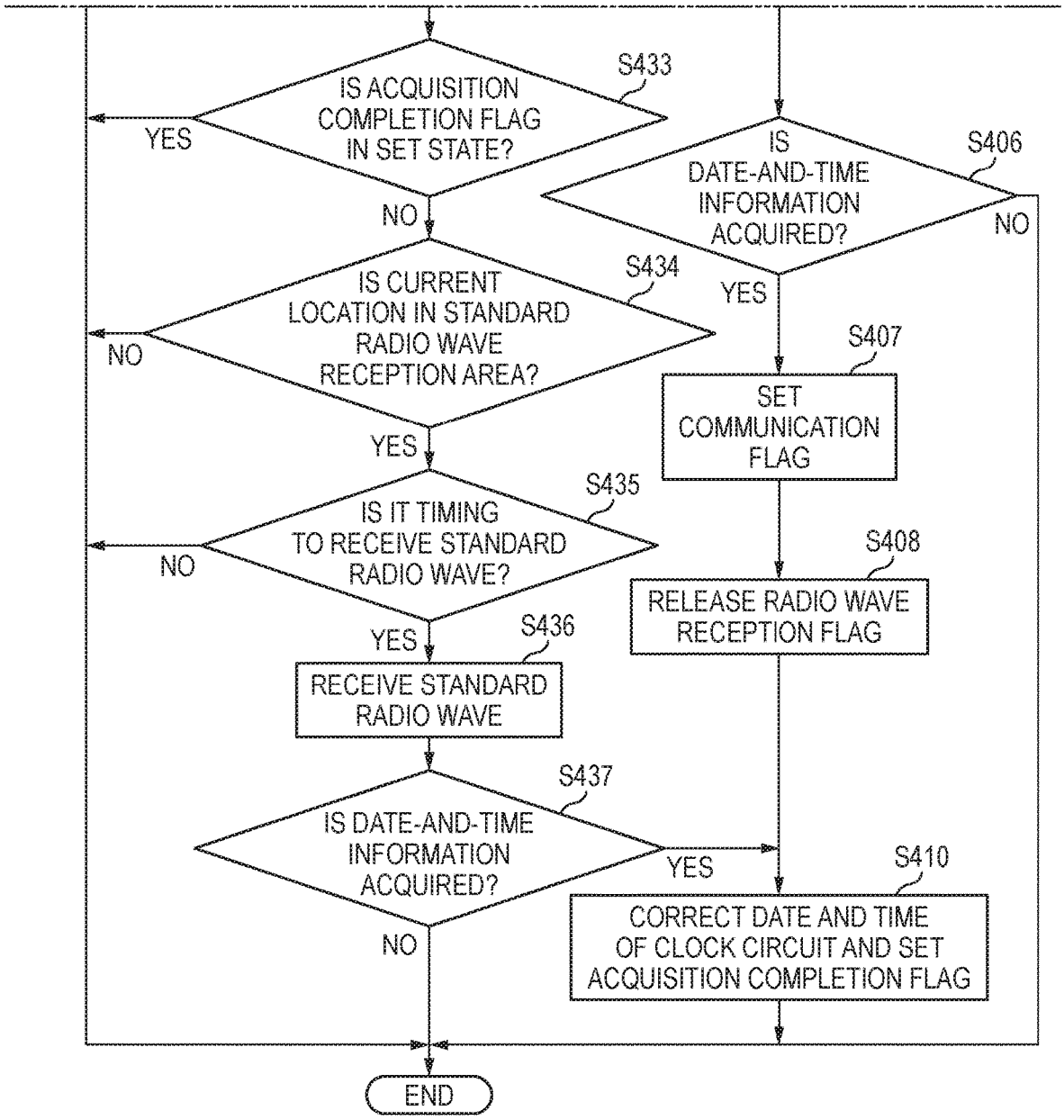

DEVICE, ELECTRONIC TIMEPIECE, AND STORAGE DEVICE

CROSS-REFERENCE TO RELATED APPLICATION

This application is based upon and claims the benefit of priority under 35 USC 119 of Japanese Patent Application No. 2016-247364 filed on Dec. 21, 2016, the entire disclosure of which, including the description, claims, drawings, and abstract, is incorporated herein by reference in its entirety.

BACKGROUND

1. Field of the Invention

The present invention relates to a device, an electronic timepiece, a method, and a storage device.

2. Description of the Related Art

In the related art, there are technologies for keeping the accuracy of an electronic timepiece by acquiring accurate time information from the outside and correcting the time counted in the electronic timepiece. For example, in JP-A-2011-252742 which is a Japanese patent document, as time information which is acquired from the outside, time codes included in standard radio waves transmitting time information using radio waves belonging to a low frequency band, navigation messages included in radio waves from positioning satellites related to GNSS (Global Navigation Satellite System), and the like are used.

Also, nowadays, a technology for acquiring time information from a portable electronic device such as a smart phone or a portable phone by near field communication such as Bluetooth (registered as a trade mark) is also known.

SUMMARY

However, there are various problems that each radio wave can be received in limited reception areas or in limited reception situations, and it takes a long time to acquire time information, and an operation necessary to acquire the time information requires a large amount of power. Therefore, it is difficult to efficiently and surely acquire time information in a short time.

An electronic timepiece, a time acquisition control method, and a storage medium are disclosed.

A device includes one or more processors. The one or more processors are configured to acquire time information by performing one or more of a first acquisition operation and a second acquisition operation. The first acquisition operation controls a communicator to communicate with an external device to receive signals including the time information. The second acquisition operation controls one or more radio wave receivers to receive transmission radio waves with signals including the time information. A time required to acquire the time information by performing the first acquisition operation is shorter than a time required to acquire the time information by performing the second acquisition operation, and/or an amount of power consumption required to acquire the time information by performing the first acquisition operation is lower than an amount of power consumption required to acquire the time information by performing the second acquisition operation. Performance of the first acquisition operation is prioritized over performance of the second acquisition operation such that the time information is acquired at least at a predetermined lower limit frequency. The one or more processors are configured to perform a correction operation of correcting a current time counted by a clock circuit based on the time information acquired.

DETAILED DESCRIPTION

Hereinafter, embodiments will be described with reference to the accompanying drawings.

First Embodiment

First, an electronic timepiece 1 of a first embodiment will be described.

Figure 1:
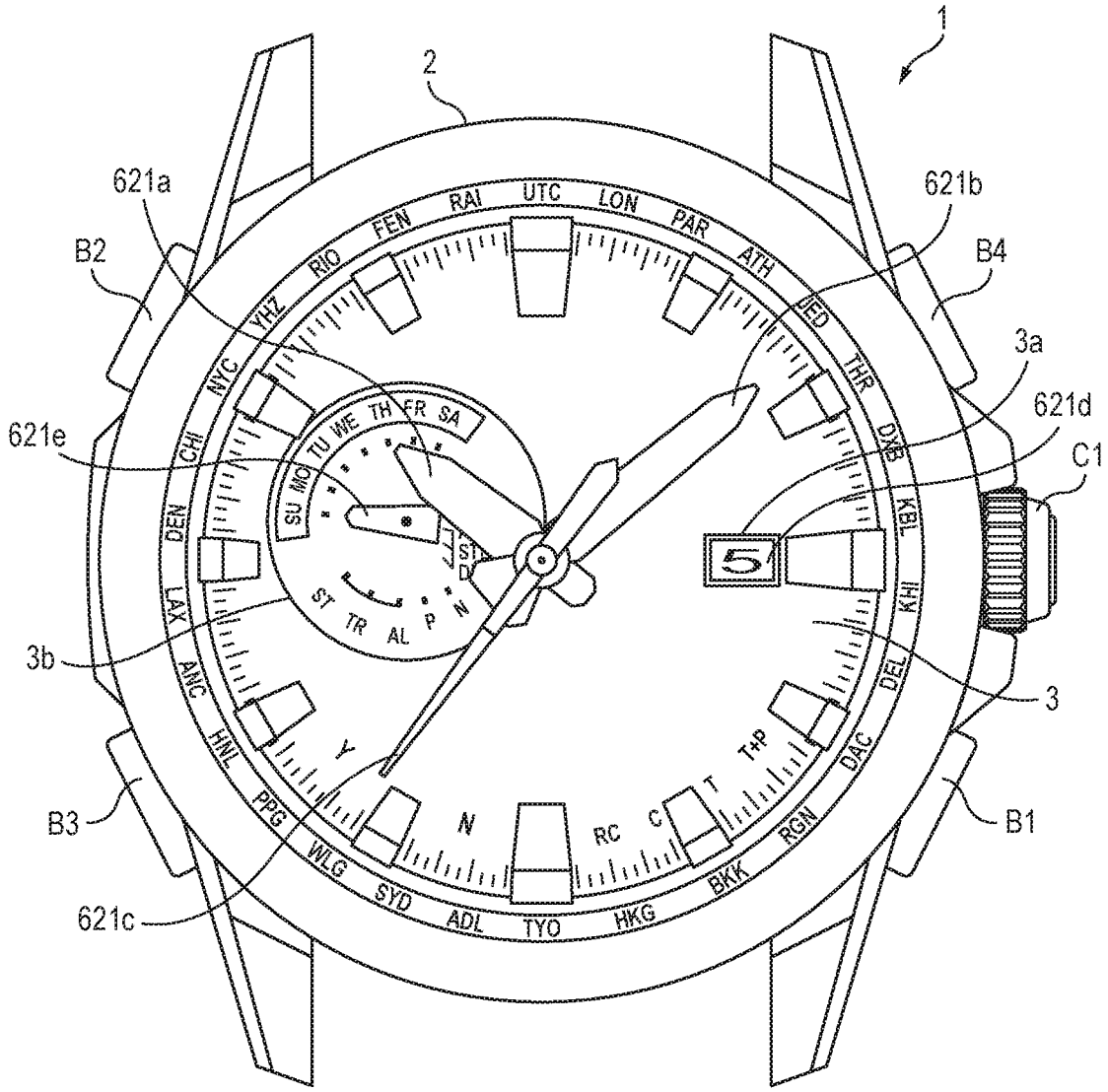
FIG. 1 is a front view illustrating an electronic timepiece of a first embodiment.

FIG. 1 is a front view illustrating the electronic timepiece 1 of the first embodiment.

The electronic timepiece 1 is a timepiece which can be worn on the body of a user, such as a watch, or a pocket watch, or the like; however, the electronic timepiece is not limited thereto.

The electronic timepiece 1 has a housing 2 and a dial plate 3, and has an hour hand 621*a*, a minute hand 621*b*, a second hand 621*c*, and a function hand 621*e* between the dial plate 3 and a transparent windshield (not shown in the drawings) configured to cover the upper surface of the dial plate. Also, on the opposite surface of the dial plate 3 to the windshield, a rotary plate 621*d* is provided in parallel to the dial plate 3 such that a part of the rotary plate is exposed from an opening 3*a* formed in the dial plate 3.

In a case of performing display date and time, the hour hand 621*a*, the minute hand 621*b*, and the second hand 621*c* indicate the hours, minutes, and seconds of the time, respectively. Also, the second hand 621*c* performs status display or display related to setting of local time by indicating various marks made on the dial plate 3 or on the peripheral part. Marks "T+P", "T", "C", and "RC" made between the direction of 4 o'clock and the direction of 6 o'clock represent reception of location measurement information from positioning satellites, reception of date-and-time information from positioning satellites, communication connection with an external device, and standard radio wave reception, respectively, and in some cases such as a case where acquisition of date-and-time information or a location measurement operation is performed or a case where a predetermined input operation requesting display of the latest acquisition history is received, the second hand 621*c* indicates one of those marks, thereby showing which means was used to acquire the date-and-time information. The rotary plate 621*d* has number marks of 1 to 31 made in an annular shape based on the position of the opening 3*a*, and one of the number marks is exposed from the opening 3*a* thereby showing a date.

The function hand 621*e* rotates inside a small window 3*b* formed in the direction of 9 o'clock of the dial plate 3, and performs display of information related to a day of the week, a function, and setting of local time. Marks "P" and "N" made in the direction of 5 o'clock inside the small window 3*b* represent a case where current location information related to setting of local time is determined according to a location measurement operation (P), and a case where current location information is determined based on a user's input operation (N), respectively.

On the side surface of the housing 2, push button switches B1 to B4 and a crown C1 are provided. If one of the push button switches B1 to B4 is pushed, an operation signal is generated and output. Also, if the crown C1 is pulled out, or rotated, or pushed back, an operation signal is generated and output. The crown C1 is configured to be able to be pulled out, for example, in two stages.

Figure 2:
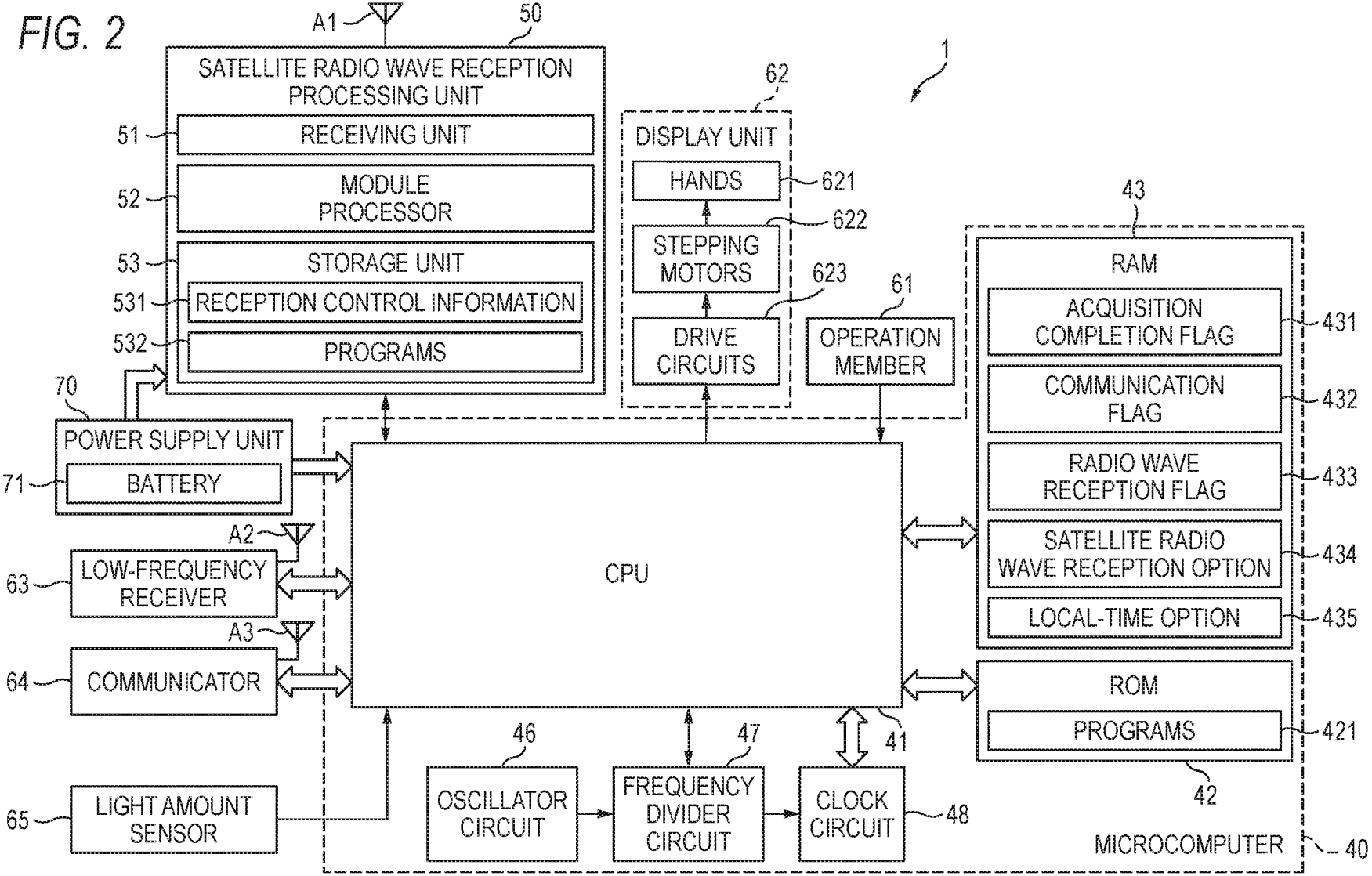
FIG. 2 is a block diagram illustrating the functional configuration of the electronic timepiece of the first embodiment.

FIG. 2 is a block diagram illustrating the functional configuration of the electronic timepiece 1 of the first embodiment.

The electronic timepiece 1 includes a microcomputer 40, a satellite radio wave reception process unit 50, an antenna A1, an operation member 61, a display unit 62, a low-frequency receiver 63, an antenna A2, a communicator 64, an antenna A3, a light amount sensor 65, a power supply unit 70, and so on.

The microcomputer 40 generally controls the operation of the whole of the electronic timepiece 1. The microcomputer 40 includes a central processing unit (CPU) 41, a read only memory (ROM) 42, a random access memory (RAM) 43 (a location storage unit), an oscillator circuit 46, a frequency divider circuit 47, a clock circuit 48 (a counter), and so on. Control operations can include not only a normal date-and-time display operation and various operations related to date-and-time correction (to be described below) but also operations according to various functions of the electronic timepiece 1, such as an alarming function, a timer function, a stopwatch function, or the like. Also, the microcomputer 40 is configured to switch the electronic timepiece to a pause mode (a sleep mode) for reducing power consumption by restricting some functions such as an operation of moving the second hand, in response to the amount of charge remaining in a battery 71 of the power supply unit 70, a nonuse state of the electronic timepiece 1 at night, and the like.

The CPU 41 is a processor for performing a variety of arithmetic processing, and performs control operations. The RAM 43 is for storing programs 421 for making the CPU 41 perform control operations, initial setting data, and so on. The ROM 42 may include a non-volatile memory such as a flash memory in which it is possible to rewrite or update data, in addition to or in place of a mask ROM. The programs 421 include a control program for a date-and-time correction control process (to be described below), a manual reception selecting process, a radio wave reception condition detecting process, and a satellite radio wave reception control process which can be called by the manual reception selecting process and the radio wave reception condition detecting process.

The RAM 43 provides a memory space for work to the CPU 41, and is for temporarily storing data.

The RAM 43 retains local time options 435 (information related to a current location) including time zone options necessary to display or use current date and time (local time) set in association with local areas such as a current location in the world and daylight saving time options. The local time options 435 can be manually set by user's input operations using the operation member 61, or can be automatically set based on a current location acquired by a location measurement operation of the satellite radio wave reception process unit 50. The clock circuit 48 counts date and time based on the local time options 435, and the CPU 41 can convert the date and time into local time in a home city or another city in the world, and output the local time.

Also, in the RAM 43, an acquisition completion flag 431, a communication flag 432, a radio wave reception flag 433, and a satellite radio wave reception option 434 are stored and retained. The acquisition completion flag 431 is a binary flag representing whether the date and time counted by the clock circuit 48 has been the corrected based on date-and-time information acquired from the outside at least once on the date of the date and time counted by the clock circuit 48. In a case where date-and-time correction has been performed at least once on the corresponding date, the acquisition completion flag 431 becomes a set state; whereas in a case where correction has not been performed at least once, the acquisition completion flag becomes a release (reset) state.

The communication flag 432 is a binary flag representing whether date-and-time information has been acquired from an external electronic device (an external device) by Bluetooth communication through the communicator 64 on the date of the date and time counted by the clock circuit 48. In a case where date-and-time information has been acquired through the communicator 64 at least once on the corresponding date, the communication flag 432 becomes a set state; whereas in a case where date-and-time information has not been acquired at least once through the communicator 64, the communication flag 432 becomes a release (reset) state.

The radio wave reception flag 433 is a binary flag determining whether to perform automatic reception of transmission radio waves from standard radio wave transmission stations and transmission radio waves from positioning satellites. In a case where the acquisition completion flag 431 is in the release state and the radio wave reception flag 433 is in the set state, automatic reception of standard radio waves is performed at predetermined standard radio wave reception timings.

The satellite radio wave reception option 434 determines whether to perform an operation of performing determination on a condition for automatically receiving transmission radio waves from positioning satellites. In a case where the satellite radio wave reception option 434 is in a set state, if the electronic timepiece 1 is in a normal operation mode, the radio wave reception condition detecting process (to be described below) is continuously performed, and if a reception condition is satisfied, an operation of receiving radio waves from positioning satellites is performed.

The oscillator circuit 46 generates a signal having a predetermined frequency, and outputs the generated signal. To generate the signal, for example, a crystal oscillator or the like can be used. The crystal oscillator may be attached to the outside of the microcomputer 40.

The frequency divider circuit 47 divides the frequency signal input from the oscillator circuit 46 at a set frequency division ratio, thereby generating a frequency division signal, and outputs the frequency division signal. The frequency division ratio option may be changed by the CPU 41.

The clock circuit 48 counts and holds current date and time (current time and date) by counting frequency division signals having a predetermined frequency and input from the frequency divider circuit 47. The current date and time which is counted by the clock circuit 48 may have some errors. For example, here, a deviation of about 0.5 seconds or less per day may occur. The CPU 41 can correct the current date and time based on some information such as accurate current date and time acquired by the satellite radio wave reception process unit 50.

The satellite radio wave reception process unit 50 performs a receiving operation of receiving transmission radio waves from positioning satellites of a satellite positioning system of the United States called GPS (Global Positioning System) and processing the transmission radio waves, thereby acquiring date-and-time information (time information and date information) and current location information, and converts information requested by the CPU 41 into a predetermined format, and outputs the corresponding information to the CPU 41. The satellite radio wave reception process unit 50 includes a receiving unit 51 (a satellite radio wave receiver), a module processor 52, a storage unit 53, and so on.

The receiving unit 51 performs a capturing process of receiving and detecting transmission radio waves from positioning satellites which are reception objects and identifying the positioning satellites and identifying the phases of the transmission radio waves, and tracks the transmission radio waves from the identified positioning satellites based on the identification information of the corresponding positioning satellites and the phases, thereby continuously demodulating and acquiring transmission signals (navigation messages).

The module processor 52 includes a CPU and so on, and performs a variety of control related to operations of the satellite radio wave reception process unit 50. The module processor 52 acquires necessary information based on extracted signals, and performs identification of the current date and time and calculation (i.e. measurement) of the current location. The module processor 52 acquires parts necessary to acquire at least desired information as acquisition objects, from transmission information from each positioning satellite based on the format of receivable navigation messages of the corresponding positioning satellite. In a case where desired information of a signal (a band L1) from a positioning satellite related to GPS (hereinafter, referred to as a GPS satellite) is date-and-time information, the module processor needs to receive acquire only date-and-time information (in a case where it is possible to specify a date from date and time counted by the clock circuit 48, at least elapsed time in a week (TOW-Count)) and the reception timing thereof. In this case, if the reception situation is good, the time required to perform a receiving operation becomes between several seconds and about 10 seconds. Also, in a case of acquiring information necessary to perform location measurement, the module processor receives and acquires orbit information (either information on orbit parameters or information on location, speed, and acceleration) of each of captured GPS satellites, in addition to the date-and-time information and the timing information thereof. In this case, if the reception situation is good, the time required to perform the receiving operation becomes about between 30 seconds and 50 seconds. In other words, in a case of receiving data necessary for location measurement, the amount of data which is a reception object is larger than that in a case of receiving only date-and-time information. Therefore, in general, the reception time lengthens, and power consumption related to the receiving operation increases. If information necessary for location measurement is acquired, the module processor 52 can calculate the current location based on the orbit information of each GPS satellite and the timing deviation of the current date and time obtained from the corresponding GPS satellite, and obtains a delay time from the accurate date and time of the identified date and time, based on the distance between each GPS satellite and the current location.

In the storage unit 53, reception control information 531 such as a variety of setting data and reception information, and programs 532 related to control to be performed by the satellite radio wave reception process unit 50 of the module processor 52 are stored. Examples of the setting data include data on the format of navigation messages of each positioning satellite, reference data for determining the level of reception, and so on. Also, examples of the reception information include acquired estimate orbit information (almanac) of each positioning satellite, leap second execution notice information, and so on.

The operation member 61 receives input operations such as user's operations from the outside. The operation member 61 include the push button switches B1 to B4 and the crown C1 described above, and outputs operation signals according to operations of pushing one of the push button switches B1 to B4 and operations of pulling out the crown C1, or rotating the crown, or pushing the crown back to the CPU 41.

The display unit 62 performs display of a variety of information based on control of the CPU 41. The display unit 62 has hands 621 installed so as to be rotatable, stepping motors 622 for rotating the plurality of hands 621, drive circuits 623 for the stepping motors 622, and so on. The plurality of hands includes the hour hand 621*a*, the minute hand 621*b*, the second hand 621*c*, the rotary plate 621*d*, and the function hand 621*e* described above. As the display unit 62, a component for performing display using a digital display screen such as a liquid crystal display (LCD) screen instead of or in addition to display using the hands may be provided.

The low-frequency receiver 63 receives and demodulates standard radio waves belonging to a low frequency band and transmitting signals (time codes) including date-and-time information (including time information and date information) via the antenna A2. In every period of one minute, date-and-time data corresponding to one minute is encoded into a time code, and the time code is transmitted, and the electronic timepiece 1 checks consistency of a plurality of reception results, for example, three reception results, thereby acquiring accurate date and time. Therefore, in a case where the reception situation is good, the reception operation time per one time becomes about 3 minutes to 4 minutes.

As standard radio waves, JJY (registered as a trade mark) of Japan, WWVB of the United States, MSF of the United Kingdom. DDF77 of Germany, and the like are widely used. The local time options 435 include information related to receivable standard radio waves, and according to the corresponding information, standard radio waves to be reception objects are determined, and in a case where the electronic timepiece is not in a reception area and cannot receive any standard radio waves, those standard radio waves are not determined as reception objects.

At least the receiving unit 51 of the satellite radio wave reception process unit 50 and the low-frequency receiver 63 constitute a receiver.

The communicator 64 performs various operations for performing near field communication (wireless communication), here, communication using Bluetooth (registered as a trade mark) (mainly a low-power-consumption version such as version 4.0) with an external electronic device (an external device), using the antenna A3, based on control of the CPU 41. The communicator 64 includes a transmitter and a receiver, transceiver, or other circuit components for performing Bluetooth communication or other communication. The communicator 64 performs control operations based on determined communication standards, and demodulates and acquires communication data input to the electronic timepiece 1, and outputs the communication data to the CPU 41, and modulates communication data to be output to an external device which is a communication object, and outputs the communication data as communication radio waves.

The light amount sensor 65 is installed, for example, in parallel to the display screen of the display unit 62, and measures the amount of light incident from the outside. As the light amount sensor 65, for example, a photodiode can be used. The light amount sensor 65 outputs an electric signal (a voltage signal or a current signal) according to the amount of incident light, and an A/D converter (ADC) (not shown in the drawings) converts the electric signal into a digital signal by sampling, and outputs the digital signal to the CPU 41.

The power supply unit 70 supplies power necessary for operations of each unit of the electronic timepiece 1, to the corresponding unit. The power supply unit 70 supplies power output from the battery 71 as operation voltage for each unit. In a case where operation voltage depends on operation parts, the power supply unit 70 performs voltage conversion using a regulator, and outputs the obtained voltage. As the battery 71, a solar panel for performing power generation based on incident light, a secondary battery for storing the generated power, and so on may be provided, or a dry battery, a rechargeable battery, or the like may be provided so as to be removable.

Of the above-described individual components, at least the CPU 41 and the module processor 52 of the satellite radio wave reception process unit 50 constitute a processor of the present invention.

Now, a date-and-time information acquiring operation which is a time acquisition control method of the electronic timepiece 1 of the present embodiment will be described.

As described above, in date and time which is counted by the clock circuit 48, a slight deviation may occur. In order to prevent a deviation of 0.5 seconds or more from occurring, it is preferable to acquire accurate date-and-time information at least once a day according to a predetermined schedule, and perform correction on current date and time (a correcting operation) based on the acquired date-and-time information. Also, even though date-and-time information is not acquired for one day, if date-and-time information is acquired in the next day, that is, once for two days (a lower-limit frequency), the deviation becomes about one second or less.

In the electronic timepiece 1, three types of information which are date-and-time information which is acquired by the satellite radio wave reception process unit 50, date-and-time information which is acquired from standard radio waves received by the low-frequency receiver 63, and date-and-time information which is acquired from an external device by Bluetooth communication through the communicator 64 are used as sources for acquiring accurate date-and-time information. In a case of acquiring date-and-time information from an external device (a first acquiring operation), for example, results of location measurement and date-and-time acquisition performed by a satellite radio wave reception process unit of the corresponding external device are acquired. Also, in a case where the external device has a portable phone function, date-and-time information can be acquired from base stations for portable phone communication, and in a case where the external device has an internet connection function, date-and-time information acquired from a time server or the like on a network can be indirectly acquired via the external device.

In these cases, between the external device and the electronic timepiece 1, beside control signals related to establishment or interruption of a communication connection, only signals related to date-and-time information requests and responses to the requests are transmitted and received. Therefore, the communication time is about 1 second or less, and the amount of communication is very small.

The electronic timepiece 1 of the present embodiment performs acquisition of date-and-time information based on communication with an external device (the first acquiring operation) before performing acquisition of date-and-time information based on reception of standard radio waves or transmission radio waves from positioning satellites (a second acquiring operation). Specifically, acquisition of date-and-time information is performed according to the following standards. (1) First, in a case where a user manually performs a predetermined input operation such that the electronic timepiece performs communication with an external device or receives radio waves from positioning satellites, the electronic timepiece acquires date-and-time information obtained by communication or radio wave reception. Also, aside from these, (2) in a case where an option related to a communication connection with an external device (a pairing option) has been set in advance, every day (a first period), a predetermined number of times (here, four times; a reference frequency), at predetermined communication timings (for example, 12:30 a.m., 6:30 a.m., 12:30 p.m., and 6:30 p.m.), the electronic timepiece automatically establishes a communication connection with the corresponding external device, and performs acquisition of date-and-time information. In a case where the pairing option has not been kept, and in a case where a communication connection with the external device paired with the electronic timepiece has never been established for one day, and acquisition of date-and-time information has not been performed (has failed), (3) on the next day (a second period, i.e. a period which is the next period of the above-described first period and has the same length as that of the first period), the electronic timepiece performs a receiving operation at predetermined reception timings (for example, 12:00 a.m., 1:00 a.m., 2:00 a.m., 3:00 a.m., 4:00 a.m., and 5:00 a.m.) at intervals of one hour (at predetermined intervals) until acquisition of date-and-time information succeeds a maximum number of times, i.e. six times (a predetermined upper limit number of times). In a case where date-and-time information is acquired in the middle of the operation, in the remaining time, the electronic timepiece does not perform reception of standard radio waves. In a case where the electronic timepiece is not in a reception area and cannot receive any standard radio waves, and in a case where the electronic timepiece has failed in receiving standard radio waves at all of the reception timings without acquiring date-and-time information, (4) the electronic timepiece receives radio waves from positioning satellites under a predetermined condition, and acquires date-and-time information.

Figure 3:
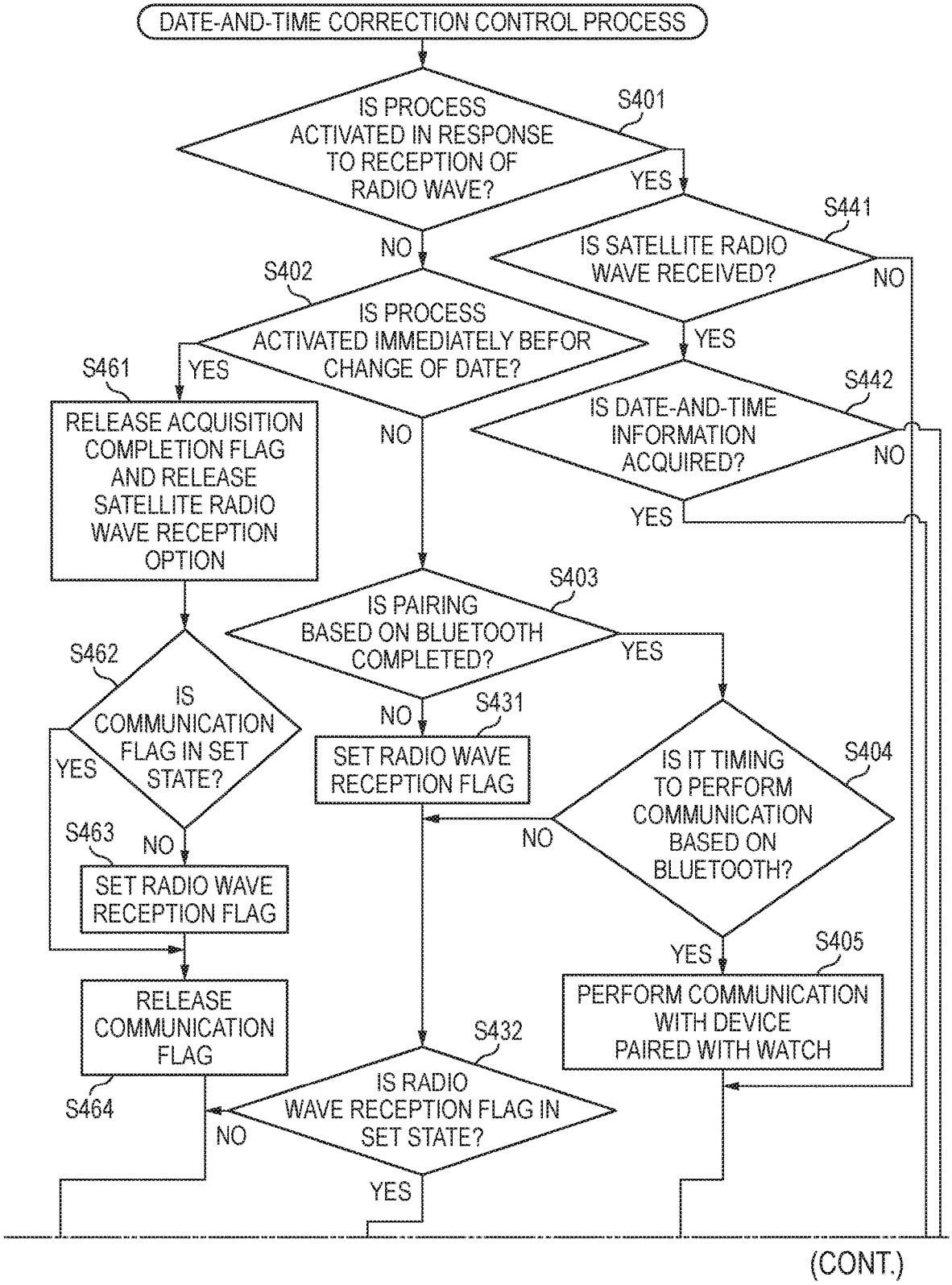
FIG. 3 is a flow chart illustrating the control procedure of a date-and-time correction control process which is performed in the electronic timepiece of the first embodiment.

FIG. 3 is a flow chart illustrating the procedure of control which is performed by the CPU 41 when the electronic timepiece 1 of the present embodiment performs a date-and-time correction control process.

In a case where a command for a communication connection with an external device is acquired based on a predetermined input operation on the operation member 61, and a communication connection is established, or in a case where reception of radio waves from positioning satellites is performed in response to a predetermined input operation on the operation member 61, at a timing immediately before the date changes (for example, when the time of the date and time counted by the clock circuit 48 is 11:59:55 p.m.), the predetermined timings for a communication connection with the external device (here, 12:30 a.m., 6:30 a.m., 12:30 p.m., and 6:30 p.m.), and predetermined timings when it is possible to receive standard radio waves (12:00 a.m., 1:00 a.m., 2:00 a.m., 3:00 a.m., 4:00 a.m., and 5:00 a.m.), the date-and-time correction control process is activated.

If the date-and-time correction control process starts, in STEP S401, the CPU 41 determines whether the date-and-time correction control process has been activated in response to radio wave reception (including radio wave reception related to Bluetooth communication) performed according to a manual operation. In a case where it is determined that the date-and-time correction control process has not started in response to radio wave reception ("NO" in STEP S401), in STEP S402, the CPU 41 determines whether the date-and-time correction control process has been activated at a timing immediately before the date changes (at 11:59:55 p.m.).

In a case where it is determined that the date-and-time correction control process has not been activated at a timing immediately before the date changes ("NO" in STEP S402), in STEP S403, the CPU 41 determines whether an option to perform pairing with an external device by Bluetooth communication has been set. In a case where it is determined that the pairing option has not been set ("NO" in STEP S403), the CPU 41 switches the radio wave reception flag 433 to the set state in STEP S431, and moves the process to STEP S432.

In a case where it is determined that the pairing option has been set ("YES" in STEP S403), in STEP S404, the CPU 41 determines whether it's a timing predetermined as a timing to perform automatic communication based on Bluetooth, here, any one of 12:30 a.m., 6:30 a.m., 12:30 p.m., and 6:30 p.m. In a case where it is determined that it's not a predetermined timing ("NO" in STEP S404), the process of the CPU 41 proceeds to STEP S432.

In a case where it is determined it's a timing predetermined as a timing to perform automatic communication based on Bluetooth ("YES" in STEP S404), in STEP S405, the CPU 41 requests the external device paired with the electronic timepiece to establish a communication connection, thereby establishing a communication connection, and acquires date-and-time information and current location information, and interrupts the communication connection. The current location information which is acquired may be a local time option related to a local area including the current location. In STEP S406, the CPU 41 determines whether date-and-time information has been acquired from the external device. In a case where it is determined that date-and-time information has not been acquired ("NO" in STEP S406), the CPU 41 finishes the date-and-time correction control process.

In a case where it is determined that date-and-time information has been acquired from the external device ("YES" in STEP S406), in STEP S407, the CPU 41 switches the communication flag 432 to the set state. Also, at this time, the CPU 41 outputs a control signal to the drive circuits 623 such that the second hand 621*c* indicates the position of a predetermined time mark "C" to show that the date-and-time information has been acquired by communication based on Bluetooth. In STEP S408, the CPU 41 switches the radio wave reception flag 433 to the reset (release) state. In STEP S409, the CPU 41 releases the satellite radio wave reception option 434. Also, in STEP S410, the CPU 41 corrects the date and time of the clock circuit 48, and switches the acquisition completion flag 431 to the set state. Then, the CPU 41 finishes the date-and-time correction control process.

If the process transitions from STEP S431 or STEP S404 to STEP S432, in STEP S432, the CPU 41 determines whether the radio wave reception flag 433 is in the set state. In a case where it is determined that the radio wave reception flag is not in the set state (the radio wave reception flag is not in the reset (release) state) ("NO" in STEP S432), the CPU 41 finishes the date-and-time correction control process.

In a case where it is determined that the radio wave reception flag 433 is in the set state ("YES" in STEP S432), in STEP S433, the CPU 41 determines whether the acquisition completion flag 431 is in the set state. In a case where it is determined that the acquisition completion flag 431 is in the set state ("YES" in STEP S433), the CPU 41 finishes the date-and-time correction control process.

In a case where it is determined that the acquisition completion flag 431 is not in the set state (the acquisition completion flag is in the reset (release) state) ("NO" in STEP S433), in STEP S434, the CPU 41 determines whether the current location is in a standard radio wave reception area, with reference to the local time options 435. In a case where it is determined that the current location is not in a standard radio wave reception area ("NO" in STEP S434), the process of the CPU 41 proceeds to STEP S439.

In a case where it is determined that the current location is in a standard radio wave reception area ("YES" in STEP S434), in STEP S435, the CPU 41 determines whether the current time is a timing predetermined as a standard radio wave reception timing, here, any one of 12:00 a.m., 1:00 a.m., 2:00 a.m., 3:00 a.m., 4:00 a.m., and 5:00 a.m. In a case where it is determined that the current time is not a standard radio wave reception timing ("NO" in STEP S435), the CPU 41 finishes the date-and-time correction control process.

In a case where it is determined that the current time is a standard radio wave reception timing ("YES" in STEP S435), in STEP S436, the CPU 41 operates the low-frequency receiver 63 such that the low-frequency receiver performs an operation of receiving a standard radio wave in the reception area including the current location, and acquires date-and-time information. In STEP S437, the CPU 41 determines whether date-and-time information has been acquired by standard radio wave reception. In a case where it is determined that date-and-time information has been acquired ("YES" in STEP S437), the process of the CPU 41 proceeds to STEP S410. In STEP S410, the CPU 41 corrects the date and time of the clock circuit 48, and switches the acquisition completion flag 431 to the set state. Also, the CPU 41 outputs a control signal to the drive circuits 623 such that the second hand 621*c* indicates the position of a predetermined time mark "RC" to show that the date-and-time information has been acquired by standard radio wave reception.

In a case where it is determined that date-and-time information has not been acquired by standard radio wave reception (standard radio wave reception has failed) ("NO" in STEP S437), in STEP S438, the CPU determines whether the timing of the receiving operation performed at this time was 5:00 a.m. In a case where it is determined that the timing of the receiving operation was not 5:00 a.m. ("NO" in STEP S438), the CPU 41 finishes the date-and-time correction control process. In a case where it is determined that the timing of the receiving operation was 5:00 a.m. ("YES" in STEP S438), the CPU 41 performs setting of the satellite radio wave reception option 434 in STEP S439, and then finishes the date-and-time correction control process.

In the determining process of STEP S401, in a case where it is determined that the date-and-time correction control process has been activated based on radio wave reception performed according to a manual operation ("YES" in STEP S401), in STEP S441, the CPU 41 determines whether transmission radio waves have been received from positioning satellites. In a case where it is determined that transmission radio waves have not been received from positioning satellites (in other words, radio waves have been received by communication based on Bluetooth) ("NO" in STEP S441), the process of the CPU 41 proceeds to STEP S406. In a case where it is determined that radio waves have been received from positioning satellites ("YES" in STEP S441), in STEP S442, the CPU determines whether date-and-time information has been acquired. In a case where it is determined that date-and-time information has been acquired ("YES" in STEP S442), the process of the CPU 41 proceeds to STEP S409. In a case where it is determined that date-and-time information has not been acquired ("NO" in STEP S442), the CPU 41 finishes the date-and-time correction control process.

In a case where it is determined in the determining process of STEP S402 that the date-and-time correction control process has been activated at a timing immediately before the date changes (at 11:59:55 p.m.) ("YES" in STEP S402), in STEP S461, the CPU 41 resets (releases) the acquisition completion flag 431, and also releases the satellite radio wave reception option 434. In STEP S462, the CPU 41 determines whether the communication flag 432 is in the set state. In a case where it is determined that the communication flag is not in the set state ("No" in STEP S462), in STEP S463, the CPU 41 switches the radio wave reception flag 433 to the set state. Thereafter, in STEP S464, the CPU 41 resets (releases) the communication flag 432. Here, since the communication flag has been in the reset state from the beginning, the process of STEP S464 may be omitted. Then, the CPU 41 finishes the date-and-time correction control process.

In a case where it is determined in the determining process of STEP S462 that the communication flag 432 is in the set state ("YES" in STEP S462), in STEP S464, the CPU 41 resets (releases) the communication flag 432. Then, the CPU 41 finishes the date-and-time correction control process.

Figure 4:
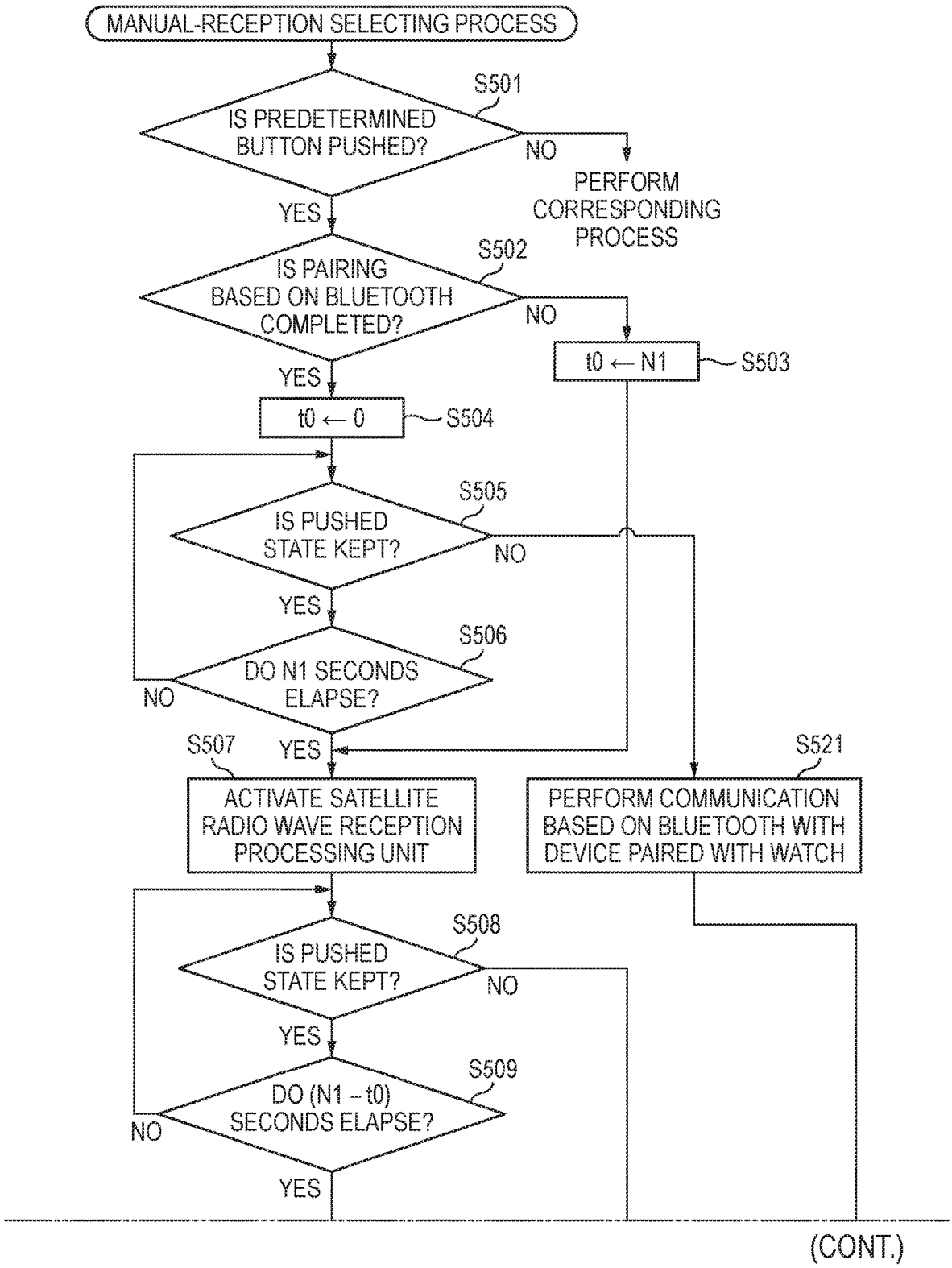
FIG. 4 is a flow chart illustrating the control procedure of a manual reception selecting process which is performed in the electronic timepiece of the first embodiment.

FIG. 4 is a flow chart illustrating the procedure of control which is performed by the CPU 41 when the electronic timepiece 1 of the present embodiment performs a manual reception selecting process.

If an operation of pushing a predetermined push button switch of the operation member 61, for example, the push button switch B3 is detected, the manual reception selecting process is performed. Here, of processing operations based on the corresponding pushing operation, parts related to a process of performing radio wave reception (including communication based on Bluetooth) will be mainly described.

If the manual reception selecting process starts, in STEP S501, the CPU 41 determines whether the predetermined push button switch (the push button switch B3) has been pushed. In a case where it is determined that an operation of pushing a push button switch other than the predetermined push button switch or an operation on the crown C has been detected ("NO" in STEP S501), a process according to the corresponding operation is performed.

In a case where it is determined that an operation of pushing the predetermined push button switch has been detected ("YES" in STEP S501), in STEP S502, the CPU 41 determines whether the pairing option related to a communication connection based on Bluetooth has been set. In a case where it is determined that the pairing option has not been set ("NO" in STEP S502), in STEP S503, the CPU 41 sets a first reference time N1 as a time t0. The, the process of the CPU 41 proceeds to STEP S507.

In a case where it is determined that the pairing option has been set ("YES" in STEP S502), in STEP S504, the CPU 41 sets "0" as the time t0. In STEP S505, the CPU 41 determines whether the pushed state of the predetermined push button switch has been kept. In a case where it is determined that the pushed state has not been kept ("NO" in STEP S505), in STEP S521, the CPU 41 acquires date-and-time information and current location information by performing Bluetooth communication with the external device paired with the electronic timepiece. Then, the process of the CPU 41 proceeds to STEP S513.

In a case where it is determined that the pushed state has been kept ("YES" in STEP S505), in STEP S506, the CPU 41 determines whether the first reference time N1 or more has elapsed after the predetermined push button switch was pushed (whether the duration of the pushed state is the first reference time N1 or more, or not). In a case where it is determined that the first reference time or more has not elapsed ("NO" in STEP S506), the process of the CPU 41 returns to STEP S505. A standby time having a predetermined length may be set from when the process returns to STEP S505 to when the operation of STEP S505 is repeated. In a case where it is determined that the first reference time N1 or more has not elapsed after the predetermined push button switch was pushed ("YES" in STEP S506), the process of the CPU 41 proceeds to STEP S507.

If the process proceeds from the process of STEP S503 or S506 to STEP S507, in STEP S507, the CPU 41 supplies power from the power supply unit 70 to the satellite radio wave reception process unit 50, thereby activating the satellite radio wave reception process unit. The satellite radio wave reception process unit 50 may start an operation of receiving radio waves (a capturing operation) immediately after initial setting is completed. In STEP S508, the CPU 41 determines whether the pushed state of the predetermined push button switch has been kept. In a case where it is determined that the pushed state has not been kept ("NO" in STEP S508), in STEP S511, the CPU 41 sets the object information acquired from positioning satellites as date-and-time information. Then, in STEP S512, the CPU 41 calls the satellite radio wave reception control process (to be described below), and performs the called process.

In a case where it is determined that the pushed state of the predetermined push button switch has been kept ("YES" in STEP S508), in STEP S509, the CPU 41 determines whether the pushed state has been kept for a time obtained by subtracting the above-described time t0 from a second reference time N2. In a case where it is determined that the pushed state has not been kept ("NO" in STEP S509), the process of the CPU 41 returns to STEP S508. In a case where it is determined that the pushed state has been kept ("YES" in STEP S509), in STEP S510, the CPU 41 sets the object information acquired from positioning satellites as location measurement information necessary for a location measurement operation. Then, in STEP S512, the CPU 41 calls the satellite radio wave reception control process, and performs the called process.

If the satellite radio wave reception control process is performed, in STEP S513, the CPU 41 calls the date-and-time correction control process, and activates the called process. Then, the CPU 41 finishes the manual reception selecting process.

In other words, in the electronic timepiece 1 of the present embodiment, according to the duration of the same operation (the operation of pushing the push button switch B3), reception objects (the type and contents of radio waves) are selected. Here, as the duration shortens, reception objects having higher priorities (communication based on Bluetooth has the highest priority, and acquisition of location information necessary for location measurement using radio waves from a positioning satellites has the lowest priority) are selected.

Figure 5:
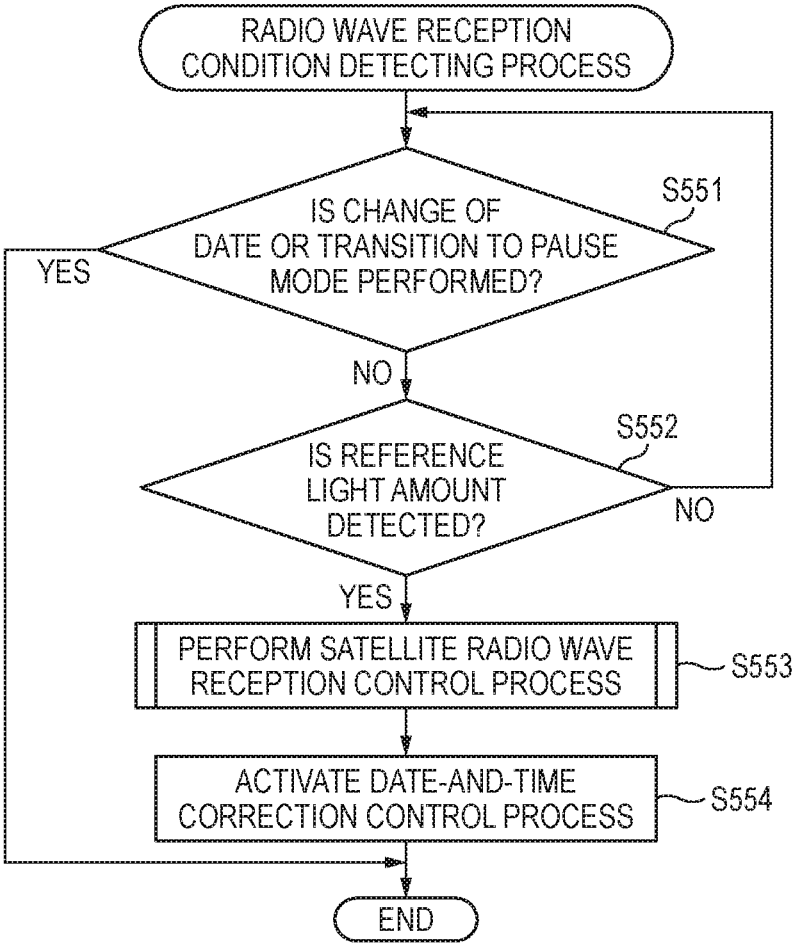
FIG. 5 is a flow chart illustrating the control procedure of a radio wave reception condition detecting process.

FIG. 5 is a flow chart illustrating the procedure of control which is performed by the CPU 41 in the radio wave reception condition detecting process for performing automatic reception of satellite radio waves according to setting of the satellite radio wave reception option 434.

When the electronic timepiece 1 is in the normal operation mode (not in the pause mode), the radio wave reception condition detecting process is continuously performed based on setting of the satellite radio wave reception option 434.

If the radio wave reception condition detecting process starts, in STEP S551, the CPU 41 determines whether the satellite radio wave reception option 434 has been released or whether the electronic timepiece has transitioned to the pause mode. In a case where it is determined that the satellite radio wave reception option 434 has been released or the electronic timepiece has transitioned to the pause mode ("YES" in STEP S551), the CPU 41 finishes the radio wave reception condition detecting process.

In a case where it is determined that the satellite radio wave reception option 434 has not been released and the electronic timepiece has not transitioned to the pause mode ("NO" in STEP S551), in STEP S552, the CPU 41 acquires the amount of light determined by the light amount sensor 65, and determines whether a reference light amount has been detected. In a case where it is determined that the reference light amount has not been detected ("NO" in STEP S552), the process of the CPU 41 returns to STEP S551.

In a case where it is determined that the reference light amount has been detected ("YES" in STEP S552), in STEP S553, the CPU 41 calls the satellite radio wave reception control process, and performs the called process. Then, the CPU 41 activates the date-and-time correction control process in STEP S554, and finishes the radio wave reception condition detecting process.

Figure 6:
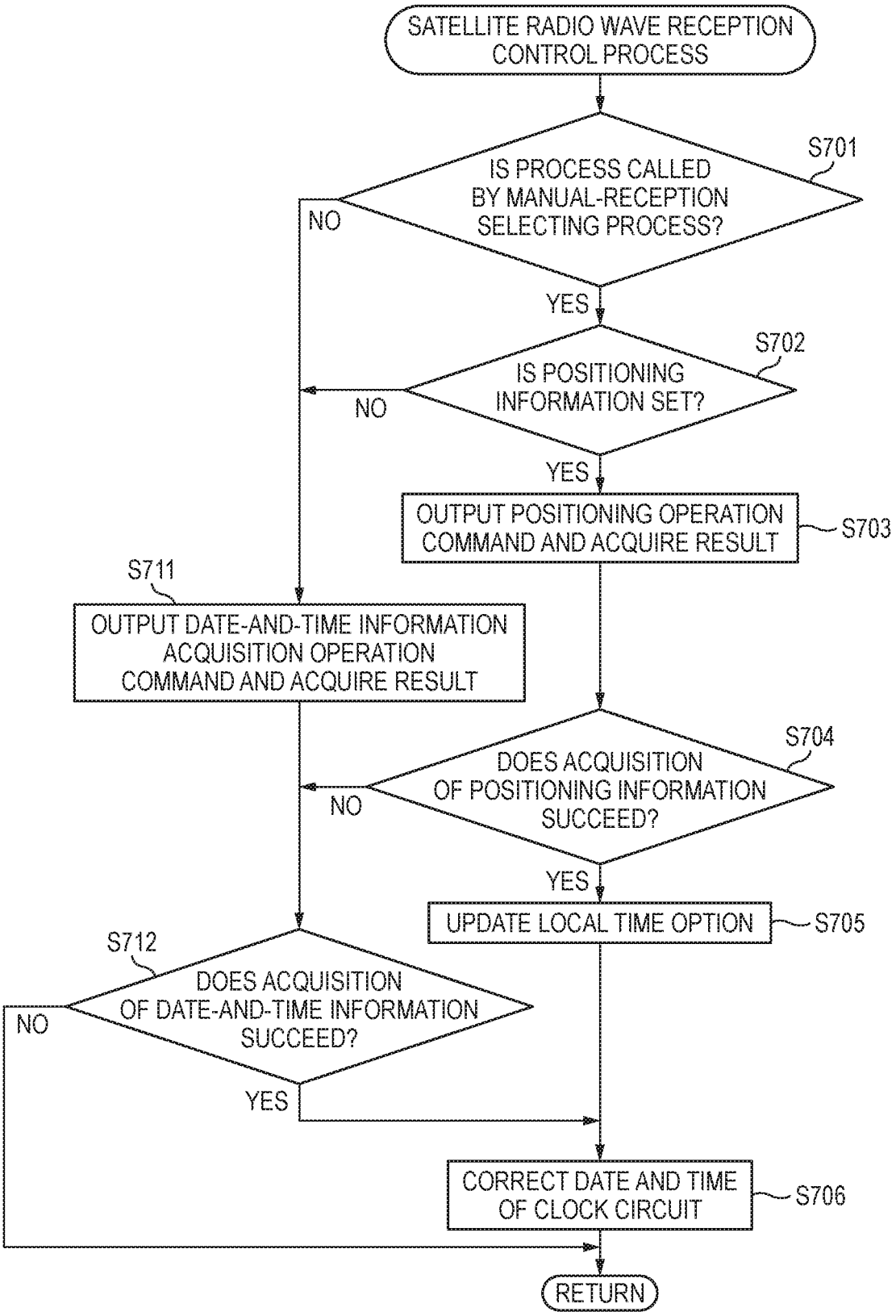
FIG. 6 is a flow chart illustrating the control procedure of a satellite radio wave reception control process.

FIG. 6 is a flow chart illustrating the procedure of control which is performed by the CPU 41 in the satellite radio wave reception control process called by the manual reception selecting process and the radio wave reception condition detecting process.

If the satellite radio wave reception control process is called, in STEP S701, the CPU 41 determines whether the corresponding process has been called by the manual reception selecting process. In a case where it is determined that the corresponding process has not been called by the manual reception selecting process, in other words, in a case where it is determined that the corresponding process has been called by the radio wave reception condition detecting process ("NO" in STEP S701), in STEP S711, the CPU 41 outputs a date-and-time acquisition operation command to the module processor 52 of the satellite radio wave reception process unit 50, and waits for a date-and-time information acquisition result to be input from the satellite radio wave reception process unit 50. If a date-and-time information acquisition result is acquired, the process of the CPU 41 proceeds to STEP S712.

In a case where it is determined that the corresponding process has been called by the manual reception selecting process ("YES" in STEP S701), in STEP S702, the CPU 41 determines whether location measurement reception has been set in the manual reception selecting process. In a case where it is determined that location measurement reception has not been set, in other words, date-and-time acquisition reception has been set ("NO" in STEP S702), the process of the CPU 41 proceeds to STEP S711.

In a case where it is determined that location measurement reception has been set ("YES" in STEP S702), in STEP S703, the CPU 41 outputs a location measurement operation command to the module processor 52 of the satellite radio wave reception process unit 50, and waits for a location measurement result to be input from the satellite radio wave reception process unit 50. If a location measurement result is input, in STEP S704, the CPU 41 determines whether acquisition of location information (i.e. location measurement) has succeeded. In a case where it is determined that acquisition of location information has not succeeded ("NO" in STEP S704), the process of the CPU 41 proceeds to STEP S712.

In a case where it is determined that location acquisition has succeeded ("YES" in STEP S704), in STEP S705, the CPU 41 updates the local time options 435 according to the acquired location information. Also, the CPU 41 outputs a control signal to the drive circuits 623, such that the second hand 621*c* indicates the position of a predetermined time mark "T+P" to show that location measurement has been performed, and the function hand 621*e* indicates the position of the mark "P" to show that the local time options 435 has been set based on the location measurement result. In STEP S706, the CPU 41 corrects the date and time counted by the clock circuit 48, based on the acquired date-and-time information. Then, the CPU 41 finishes the radio wave reception condition detecting process, and the process of the CPU 41 returns to the flow related to the original process which called the radio wave reception condition detecting process.

If the CPU proceeds from the process of STEP S711 or S704 to the process of STEP S712, in STEP S712, the CPU 41 determines whether acquisition of date-and-time information has succeeded. In a case where acquisition of date-and-time information has succeeded ("YES" in STEP S712), the process of the CPU 41 proceeds to STEP S706. At this time, the CPU 41 outputs a control signal to the drive circuits 623 such that the second hand 621*c* indicates the position of a predetermined time mark "T" to show that the date-and-time information has been acquired from positioning satellites. In a case where it is determined that acquisition of date-and-time information has not succeeded ("NO" in STEP S712), the CPU 41 finishes the radio wave reception condition detecting process, and the process of the CPU 41 returns to the flow related to the original process which called the radio wave reception condition detecting process.

As described above, the electronic timepiece 1 of the first embodiment includes the communicator 64 for performing wireless communication with an external device, the low-frequency receiver 63 and the receiving unit 51 (collectively referred to as a receiver) for receiving radio waves transmitting signals including time information, the clock circuit 48 for counting current date and time, and the CPU 41 and the module processor 52 (collectively referred to as a processor). The processor can perform the first acquiring operation of acquiring date-and-time information from an external device through the communicator 64, and the second acquiring operation of acquiring date-and-time information from radio waves received by the receiver. When performing acquisition of date-and-time information four times a day based on the predetermined schedule related to automatic reception, the processor selectively performs an operation of acquiring date-and-time information through the communicator 64 and an operation of acquiring date-and-time information by the receiver, such that acquisition of date-and-time information through the communicator 64 is performed before acquisition of date-and-time information by the receiver is performed, and date-and-time information is acquired at least once for two days (the lower limit), and performs an operation of correcting current date and time counted by the clock circuit 48, based on the acquired date-and-time information.

As described above, the operation of acquiring only necessary information within a short distance by bi-directional communication through the communicator 64 is preferentially performed. Therefore, in general, the time required to acquire date-and-time information decreases, and the power consumption also decreases. Also, it is possible to suppress influence of noise and the like when reception is possible. Meanwhile, since an external device set as an object may not be operating, in a certain situation in which an external electronic device such as a smart phone or a portable phone belonging to the user of the electronic timepiece 1 is used, communication may be impossible. In this case, standard radio waves which are continuously transmitted, or radio waves which are continuously transmitted from positioning satellites are received. Therefore, certainty of acquisition of date-and-time information does not decrease. Therefore, the electronic timepiece 1 can balance certainty of acquisition of date-and-time information with time efficiency.

Also, in a case where the operation of acquiring date-and-time information through the communicator 64 is tried four times on a day, but the acquiring operation does not succeed on that day, the processor tries the operation of acquiring date-and-time information by receiving standard radio waves or radio waves transmitted from positioning satellites based on the automatic reception schedule in the date-and-time correction control process and the radio wave reception condition detecting process.

As described above, in principle, acquisition of date-and-time information through the communicator 64 is performed, and only in a case where acquisition of date-and-time information through the communicator 64 continues to fail in a period for keeping accuracy required for the date and time counted by the clock circuit 48, reception of radio waves is performed. Therefore, it is possible to prevent occurrence of time and power consumption for an operation of receiving unnecessary radio waves, and keep the accuracy of the date and time counted by the clock circuit 48 at the lowest limit or more.

Also, in a case where pairing has not been performed by a communication connection with an external device using the communicator 64 on a day, the processor tries an operation of acquiring date-and-time information by receiving standard radio waves or radio waves transmitted from positioning satellites based on setting of an automatic reception schedule.

As described above, in a case where communication with an external device through the communicator 64 is difficult at all events, the processor quickly performs radio wave reception the necessary minimum number of times without performing an operation of acquiring date-and-time information by communication using the communicator 64. Therefore, it is possible to appropriately keep the accuracy of the date and time counted by the clock circuit 48.

Also, in a case where a date has been set to try to acquire date and time by receiving radio waves, if date-and-time information is acquired once on the corresponding date by receiving radio waves or by communication through the communicator 64, in the remaining time on the corresponding date, the processor does not perform radio wave reception again. In other words, an operation of correcting the date and time counted by the clock circuit 48 by receiving radio waves is performed once a day. Therefore, it is possible to perform date-and-time acquisition using radio wave reception requiring more power than that of the operation of correcting the date and time using the communicator 64 and requiring a long time to acquire date-and-time information, a minimum number of times necessary to keep the accuracy, and keep the balance between maintenance of the accuracy and power consumption in an appropriate range.

Also, in a case where a date has been set to try to acquire date and time by receiving radio waves, on the corresponding date, the processor tries a date-and-time acquiring operation using standard radio wave reception, no more than six times, until date-and-time acquisition through the communicator 64 or date-and-time acquisition using standard radio wave reception succeeds.

As described above, with respect to standard radio wave reception which does not require an extremely large amount of power but requires a long reception time (such as several minutes), or the like, even though reception fails, reception is tried a plurality of times. Therefore, it is possible to prevent a significant increase in power consumption, and minimize the possibility that date-and-time information cannot be acquired, thereby efficiently suppressing a decrease in the accuracy of the date and time counted by the clock circuit 48.

Also, one day which is the unit of the period of date-and-time acquisition through the communicator 64 and one day which is the unit of the period of date-and-time acquisition using radio wave reception in a case where acquisition of date and time through the communicator 64 fails are set. Therefore, it is possible to surely and efficiently acquire date-and-time information by selecting a date-and-time information acquiring means according to the order of priority by a simple process.

Also, the receiver includes the low-frequency receiver 63 for receiving radio waves in a low frequency band.

Therefore, even in a situation in which it is impossible to acquire date-and-time information from an external device such as a smart phone, it is possible to acquire accurate date-and-time information in a wide range such as Japan, the United States, or Europe.

Also, the receiver includes the receiving unit 51 for receiving radio waves from positioning satellites.

Therefore, even in a situation in which it is impossible to acquire date-and-time information from an external device such as a smart phone, it is possible to acquire accurate date-and-time information throughout the world.

Also, in a case of acquiring date-and-time information by receiving radio waves, the processor performs reception of standard radio waves belonging to a low frequency band by the low-frequency receiver 63 before performing reception of radio waves from a positioning satellite by the receiving unit 51.

Since power consumption related to reception of standard radio waves is less than power consumption related to reception of radio waves from a positioning satellite, reception of standard radio waves is performed first. Therefore, it is possible to reduce the frequency of excessive loads on the battery 71.

Also, in a case where an operation of acquiring date-and-time information though the communicator 64 is tried four times on one day, but acquisition of date-and-time information fails on that day, the processor tries to receive radio waves belonging to a low frequency band by the low-frequency receiver 63 no more than six times. In a case where time information is not acquired during the six times of reception, the processor tries to receive radio waves from positioning satellites by the receiving unit 51 under a predetermined condition. As described above, priority is set so as to decrease as power consumption related to acquisition of date-and-time information increases, and in a case where date-and-time acquisition using a means having a higher priority is failed, a means having a lower priority is used. Therefore, it is possible to keep the accuracy of the date and time counted by the clock circuit 48, without reducing certainty related to acquisition of date-and-time information, while appropriately suppressing power consumption.

Also, the RAM 43 for storing the local time options 435 as information related to current location is provided. In a case where even though an operation of acquiring date-and-time information through communicator 64 has been tried four times on one day, acquisition of date-and-time information has failed, and the current location is not in a standard radio wave reception area, the processor tries to receive radio waves from positioning satellites by the receiving unit 51 under a predetermined condition. In other words, the processor determines whether the current location is inside a standard radio wave reception area, in advance. If the current location is inside a reception area, the processor performs reception of radio waves from positioning satellites without performing an operation of receiving standard radio waves. Therefore, it is possible to prevent an operation of receiving standard radio waves from unnecessarily continuing for a long time. Therefore, it is possible to prevent waste of power and delay of acquisition of date-and-time information.

Also, the operation member 61 for receiving user's operations is provided, and the processor can perform an operation of acquiring date-and-time information by receiving radio waves from positioning satellites based on an input operation on the push button switch B3 received by the operation member 61. Also, in a case where date-and-time information is acquired by receiving radio waves in response to a manual operation as described above, in the remaining time on that day, the processor does not automatically perform an operation of receiving radio waves and acquiring date-and-time information based on setting of the schedule.

In other words, in a case where the user acquires date-and-time information for location measurement or the like, the acquired information is effectively used, and automatic acquisition of date-and-time information is not performed again. Therefore, the electronic timepiece 1 can appropriately keep the accuracy of date and time counted by the clock circuit 48 while saving unnecessary power consumption and time required for the operation of acquiring date-and-time information.

Also, the processor performs an operation of selecting one of reception of radio waves by communication with an external device through the communicator 64 or reception of radio waves from a positioning satellite by the receiving unit 51, based on their priories and the duration of the pushed state of the push button switch B3 of the operation member 61.

As described above, operations related to the same purpose of acquiring date-and-time information is assigned to the same input operation. Therefore, it is possible to simply determine an operation while using limited operation parts. Also, as the duration of the pushed state of the push button switch B3 lengthens, a process having a lower priority is performed. Therefore, it is possible to reduce the effort of the user to perform the pushing operation for a long time. Also, since the correspondence relation is simply determined, the user can easily understand necessary pushing time.

Also, in a case of performing reception of radio waves from positioning satellites by the receiving unit 51 based on an operation of pushing the push button switch B3, the processor determines whether to acquire location information necessary for location measurement, according to the duration of the pushed state of the push button switch B3. In other words, in the electronic timepiece 1, a case of acquiring only date-and-time information and an operation of performing a location measurement operation are activated by the same operation, and are distinguished by the duration of the pushed state of the push button switch B3. Therefore, it is possible to perform a process requiring a large amount of power only in a case where it is necessary, without complicating the operation and without carelessly activating the corresponding process.

Also, a time acquisition control method of the electronic timepiece 1 of the present embodiment includes a first acquiring step of acquiring time information from an external device through the communicator 64 (STEP S405 or S521), a second acquiring step of acquiring time information from radio waves received by the low-frequency receiver 63 and the receiving unit 51 (STEP S436, S707, or S711), an acquiring-means selecting step of selecting one of the first acquiring step and the second acquiring step such that when acquisition of time information is automatically performed four times a day based on setting of the predetermined schedule, acquisition of time information by the first acquiring step is performed before acquisition of time information by the second acquiring step is performed, and time information is acquired once or more every two days (STEP S407, S408, S432, S462 to S464, or the like), and a correcting step of correcting the current time counted by the clock circuit 48 based on the acquired time information (STEP S410 or S706).

As described above, the pattern in which desired date-and-time information is selectively acquired in a short time through the communicator 64 is performed first, and in a case where date and time cannot be acquired through the communicator 64, switching to acquisition of date-and-time information by radio wave reception is quickly performed. Therefore, it is possible to surely acquire date-and-time information in the wide range of the world, without unnecessarily increasing power consumption and the time required to acquire date-and-time information, even in a case where it is impossible to acquire date-and-time information from an external device due to the operation situation of the external device and the positional relation between the external device and the electronic timepiece 1. Therefore, it is possible to balance certainty of acquisition of time information with time efficiency in the electronic timepiece 1.

Also, the programs 421 installed in the electronic timepiece 1 of the present embodiment make the electronic timepiece 1 (the microcomputer 40) function as a first acquiring means for acquiring time information from an external device through the communicator 64 (STEP S405 or S521), a second acquiring means for acquiring time information from radio waves received by the low-frequency receiver 63 and the receiving unit 51 (STEP S436, S707, or S711), an acquiring-means selecting means for selecting one of the first acquiring means and the second acquiring means such that when acquisition of time information is automatically performed four times a day based on the predetermined schedule, acquisition of time information by the first acquiring means is performed before acquisition of time information by the second acquiring means is performed, and time information is acquired once or more every two days (STEP S407, S408, S432, S462 to S464, or the like), and a correcting means for correcting the current time counted by the clock circuit 48 based on the acquired time information (STEP S410 or S706).

As described above, it is possible to surely acquire date-and-time information by software control while easily performing control so as not to increase power consumption and the time required for the date-and-time acquiring operation. Therefore, it is possible to balance certainty of acquisition of time information with time efficiency in the electronic timepiece 1.

Second Embodiment

Now, an electronic timepiece 1*a* of a second embodiment will be described.

Figure 7:
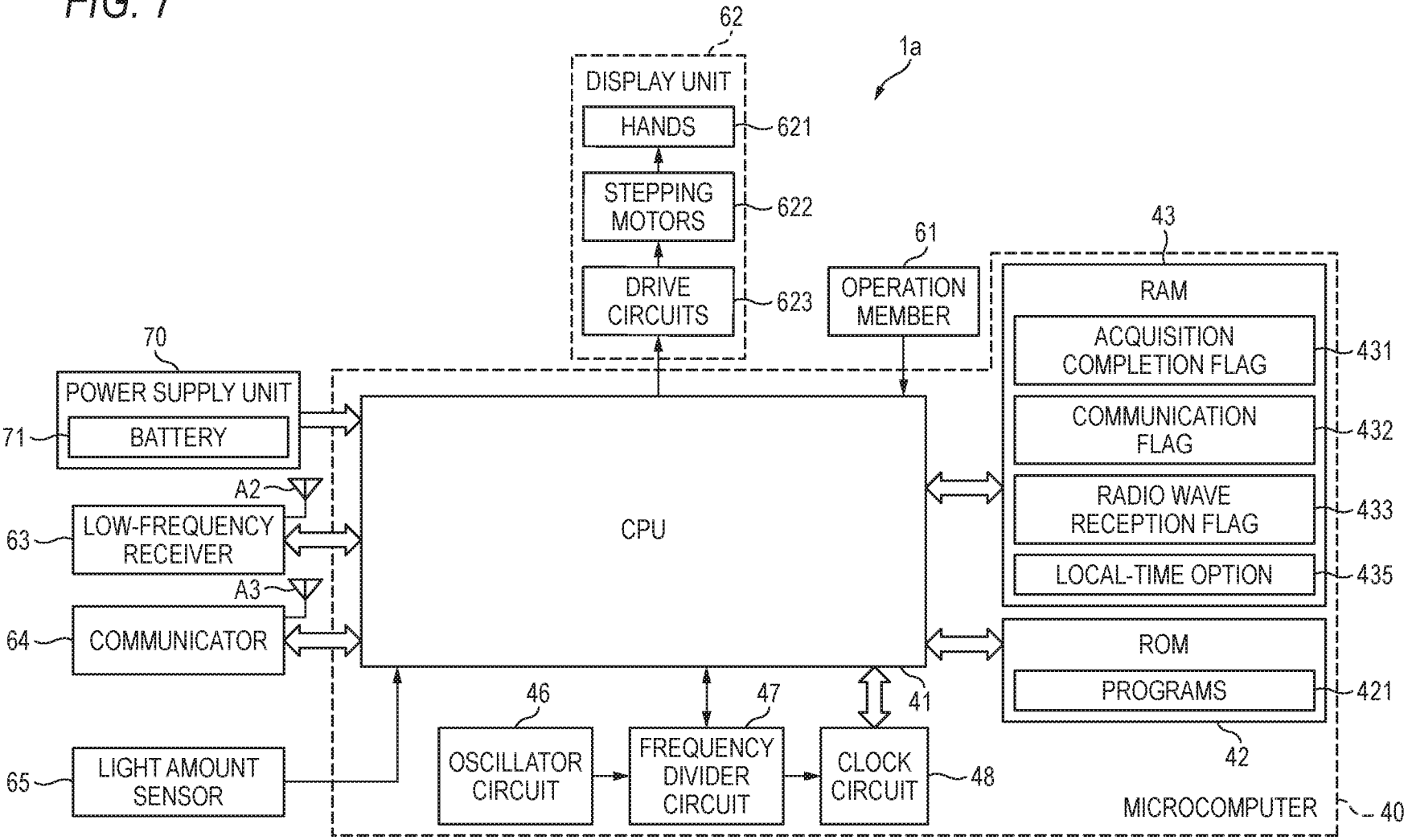
FIG. 7 is a block diagram illustrating the functional configuration of an electronic timepiece of a second embodiment.

FIG. 7 is a block diagram illustrating the functional configuration of the electronic timepiece 1*a* of the second embodiment.

The electronic timepiece 1*a* of the present embodiment is different from the electronic timepiece 1 of the first embodiment in that it does not have the satellite radio wave reception process unit 50 and the antenna A1. Therefore, in the RAM 43, the satellite radio wave reception option 434 is not stored. The other configuration is the same as that of the electronic timepiece 1 of the first embodiment, and components identical to each other are denoted by the same reference symbols, and will not be described.

Now, a date-and-time correction operation of the electronic timepiece 1*a* of the present embodiment will be described.

In the electronic timepiece 1*a*, date-and-time acquisition using communication based on Bluetooth is performed before date-and-time acquisition based on standard radio wave reception is performed, and in a case where communication based on Bluetooth is impossible and in a case where communication does not succeed for a predetermined period or more, an operation of receiving standard radio waves is performed.

Figure 8:
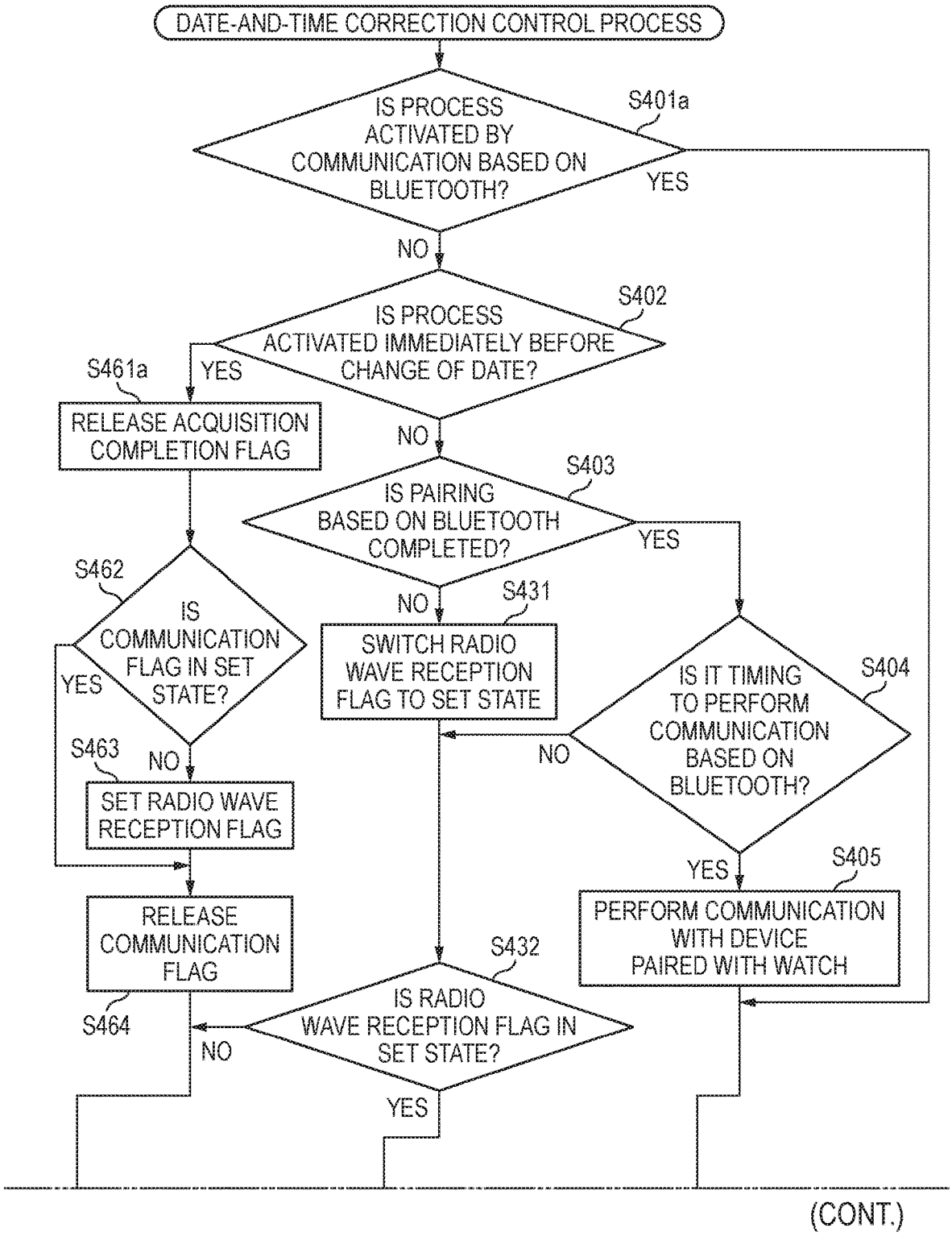
FIG. 8 is a flow chart illustrating the control procedure of a date-and-time correction control process which is performed in the electronic timepiece of the second embodiment.

FIG. 8 is a flow chart illustrating the procedure of control which is performed by the CPU 41 when the electronic timepiece 1*a* of the present embodiment performs a date-and-time correction control process.

This date-and-time correction control process is different from the date-and-time correction control process which is performed by the electronic timepiece 1 of the first embodiment in that it does not include STEPS S409, S438, S439, S441, and S442 and includes processes of STEPS S401*a* and S461*a* in place of the processes of STEPS S401 and S461. The other processes are identical to those of the first embodiment, and process contents identical to each other are denoted by the same reference symbols and will not be described in detail.

If the date-and-time correction control process starts, in STEP S401*a*, the CPU 41 determines whether the date-and-time correction control process has been activated by Bluetooth communication performed in response to a manual operation. In a case where it is determined that the date-and-time correction control process has been activated by Bluetooth communication ("YES" in STEP S401*a*), the process of the CPU 41 proceeds to STEP S406. In a case where it is determined that the date-and-time correction control process has not been activated by communication based on Bluetooth ("NO" in STEP S401*a*), the process of the CPU 41 proceeds to STEP S402.

If the radio wave reception flag 433 is reset (released) in the process of STEP S408, in STEP S410, the CPU 41 corrects the date and time of the clock circuit 48, and switches the acquisition completion flag 431 to the set state.

Also, if the result of the determining process of STEP S402 is "YES", in STEP S461*a* the CPU 41 resets (releases) the acquisition completion flag 431. Then, the process of the CPU 41 proceeds to STEP S462.

Also, if the result of the determining process of STEP S437 is "NO", the CPU 41 immediately finishes the date-and-time correction control process.

As described above, the electronic timepiece 1*a* of the present embodiment does not include the satellite radio wave reception process unit 50, and does not perform acquisition of date-and-time information based on reception of radio waves from positioning satellites. Even in this electronic timepiece 1*a*, similarly in the electronic timepiece 1 of the first embodiment, acquisition of date-and-time information through the communicator 64 capable of acquiring necessary information in a short time is performed first, and in a case where it is impossible to acquire date-and-time information through the communicator 64 at a necessary frequency, switching to standard radio wave reception is performed, and date-and-time information is acquired. Therefore, it is possible to reduce power consumption while keeping the certainty of acquisition of date-and-time information. Also, since the time required to acquire date-and-time information does not unnecessarily lengthen, it is possible to improve time efficiency.

However, the present invention is not limited to the above-described embodiments, and can be modified in various forms.

For example, in the above-described embodiments, the electronic timepieces 1 and 1*a* having a communication function based on Bluetooth and a function of receiving standard radio waves, and further has a function of receiving radio waves from positioning satellites have been described; however, the electronic timepieces may have the function of receiving radio waves from positioning satellites, without having the function of receiving standard radio waves. Even in a case, acquisition of date-and-time information based on Bluetooth is performed before acquisition of date-and-time information based on reception of radio waves from positioning satellites is performed.

Also, in the above-described embodiments, the number of times it is possible to try to acquire date and time by communication based on Bluetooth is set to four times a day, and the number of times it is possible to try to acquire date and time by reception of standard radio waves or radio waves from positioning satellites is set to once a day; however, the present invention is not limited thereto. The different numbers of times may be set. Also, instead of performing communication based on Bluetooth four times a day, four candidate timings may be set. In this case, if date-and-time information is acquired once, communication and date-and-time acquisition may not be performed at the remaining timings on the corresponding day. Alternatively, only at the next candidate timing, communication and date-and-time acquisition may not be performed.

Also, in the above-described embodiments, reception of a standard radio wave is performed before reception of a radio wave from a positioning satellite; however, reception of a radio wave from a positioning satellite may be performed before reception of a standard radio wave, or priorities may be set according to situations.

Also, in the above-described embodiments, according to whether date-and-time acquisition based on Bluetooth communication has succeeded on a day, whether to perform reception of a radio wave on the next day is determined; however, based on elapsed time from the last date-and-time acquisition based on Bluetooth communication, the number of times communication has failed, and so on, whether to perform reception of a radio wave after the last acquisition may be determined. For example, in a case where a Bluetooth communication connection with an external device continues to fail four times from a communication timing of 12:30 p.m. on one day to 6:30 a.m. on the next day, an operation of receiving a radio wave may become possible after 6:30 p.m. on the next day. In this case, since the timing when it becomes possible to perform the operation of receiving a radio wave is immediately after the standard radio wave reception timing finishes, reception of a radio wave from a positioning satellite may be performed without performing an operation of receiving a standard radio wave.

Also, even in a case of managing the date-and-time information acquisition situation In this case, in order to succeed in date-and-time acquisition at least once in one day, in a case where date-and-time acquisition based on Bluetooth communication continues fails three times from 12:30 p.m., reception of a standard radio wave after 1 p.m., reception of a radio wave from a positioning satellite after the next morning may be performed.

Also, radio waves which are reception objects may include radio waves other than standard radio waves and radio waves of positioning satellites in a low frequency band, for example, standard radio waves and the like in a short wavelength range.

Also, in the above-described embodiments, reception of a standard radio wave is performed only according to the schedule, and is not performed based on a user's operation; however, reception of a standard radio wave may be performed at an arbitrary timing based on a user's operation.

Also, in the above-described embodiments, switching to communication based on Bluetooth, radio wave reception related to acquisition of date-and-time information from a positioning satellite, or radio wave reception related to acquisition of information necessary for location measurement is performed based on the duration of the pushed state of the push button switch B3; however, the switching may be performed in a different manner, for example, based on the duration of an operation of rotating the crown C1. Alternatively, the switching may be simply performed in response to operations on different push button switches. Also, for example, only in a case where it is desired to perform a location measurement operation, receiving operations related to location measurement may start in response to different operation contents, respectively.

Also, in the above description embodiments, communication based on Bluetooth has been described as an example; however, the communication means is not particularly limited as long as they can surely acquire time information (date-and-time information) in a short time when an external device (including a server or the like) which is a connection destination of near field communication and a wireless LAN is operating near the electronic timepiece. Also, a plurality of communication means may be used together. However, since it is more preferable to use a communication means requiring less power like Bluetooth 4.0 (Low Energy), priorities may be appropriately determined according to power consumption, necessary communication time, and the like. Also, in a case where date-and-time acquisition fails even though all means has been used, switching to a date-and-time acquisition based on radio wave reception is performed.

Also, in the above-described embodiments, setting is performed such that while it is possible to acquire date-and-time information based on Bluetooth communication, radio wave reception is not automatically performed, however, reception setting may be performed such that radio wave reception is performed at least at a predetermined frequency for a plurality of days, one week, or one month.

Also, in the above-described embodiments, detection of the reference light amount or more by the light amount sensor 65 has been described as an example of the predetermined condition related to reception of a radio wave from a positioning satellite; however, the present invention is not limited thereto. Other conditions such as detection of a predetermined vibration operation or wind, temperature change, and the like may be used or added. Also, in addition to measurement of a physical amount in the corresponding place, elapsed time from the previous radio wave reception from a positioning satellite, or the like may be considered.

Also, in the above description, the ROM 42 capable of including a non-volatile memory has been described as an example of a medium from which the programs 421 related to the date-and-time correction operation according to the present invention can be read by a computer; however, the present invention is not limited thereto. As other computer-readable media, HDD (hard disk drive) and portable recording media such as CD-ROM and DVD can be applied. Also, as media for providing program data according to the present invention through a communication line, carrier waves also can be applied to the present invention.

Moreover, the details such as specific components and numerical values shown in the above described embodiments can be appropriately changed without departing from the scope of the present invention.

Although some embodiments of the present invention have been described, the scope of the present invention is not limited to the above described embodiments, and includes the scopes of inventions disclosed in claims and the scopes of their equivalents.

The following is the inventions disclosed in the claims originally attached to this application. The numbering of the claims appended is the same as the numbering of the claims originally attached to this application.

What is claimed is:

1. A device comprising:

one or more processors configured to:

acquire time information by performing one or more of:

a first acquisition operation to control a communicator to communicate with an external device to receive signals including the time information; and a second acquisition operation to control one or more radio wave receivers, different from the communicator, to receive transmission radio waves with signals including the time information, wherein an amount of power consumption required to acquire the time information by performing the first acquisition operation is lower than an amount of power consumption required to acquire the time information by performing the second acquisition operation, and wherein performance of the first acquisition operation is prioritized over performance of the second acquisition operation such that the time information is acquired at least at a predetermined lower limit frequency; and perform a correction operation of correcting a current time counted by a clock circuit based on the time information acquired.

2. The device according to claim 1, wherein the one or more processors are configured to:

perform the first acquisition operation during a first period;

determine whether the time information was acquired by the first acquisition operation during the first period; and in response to determining that the time information was not acquired by the first acquisition operation during the first period, perform the second acquisition operation on a predetermined schedule during a second period after the first period.

3. The device according to claim 1, wherein the one or more processors are configured to:

control the communicator to establish a communication connection with the external device in a first period;

determine whether the communication connection was established in the first period; and in response to determining that the communication connection was not established in the first period, perform the second acquisition operation on a predetermined schedule during a second period after the first period.

4. The device according to claim 1, wherein the one or more processors are configured to:

determine whether the time information was acquired by performing the first acquisition operation during a first period;

determine whether the time information was acquired at least once by performing the second acquisition operation during a second period following the first period; and in response to determining that the time information was acquired by performing the first acquisition operation during the first period and/or by performing the second acquisition operation during the second period, avoid performing the second acquisition operation again in a remaining time of the second period.

5. The device according to claim 4, wherein the one or more processors are configured to perform the second acquisition operation no more than a predetermined upper limit number of times.

6. The device according to claim 4, wherein the length of the first period and the length of the second period are the same.

7. The device according to claim 1, wherein the one or more processors are configured to acquire the time information by performing the second acquisition operation to control one or more of:

a low-frequency radio wave receiver to receive the transmission radio waves in a low frequency band with the signals including the time information; and a satellite radio wave receiver to receive the transmission radio waves with the signals including the time information from positioning satellites.

8. The device according to claim 7, wherein the one or more processors are configured to:

in a first period, acquire the time information by performing the first acquisition operation;

determine whether the time information was acquired by performing the first acquisition operation;

in response to determining that the time information was not acquired by performing the first acquisition operation, in a second period after the first period, acquire the time information by performing the second acquisition operation to control the low-frequency radio wave receiver to receive the transmission radio waves in the low frequency band with the signals including the time information;

determine whether the time information was acquired by performing the second acquisition operation to control the low-frequency radio wave receiver to receive the transmission radio waves; and in response to determining that the time information was not acquired by performing the second acquisition operation to control the low-frequency radio wave receiver to receive the transmission radio waves, acquire the time information by performing the second acquisition operation to control the satellite radio wave receiver to receive the transmission radio waves with the signals including the time information from the positioning satellites.

9. The device according to claim 7, wherein the one or more processors are configured to:

in a first period, acquire the time information by performing the first acquisition operation;

determine whether the time information was acquired by performing the first acquisition operation; and in response to determining that the time information was not acquired by performing the first acquisition operation, in a second time period:

acquire a current location of the device;

determine whether the current location of the device is a location where the low-frequency radio wave receiver can receive the transmission radio waves in the low frequency band; and in response to determining that the current location of the device is not a location where the low-frequency radio wave receiver can receive the transmission radio waves in the low frequency band, acquire the time information by performing the second acquisition operation to control the satellite radio wave receiver to receive the transmission radio waves with the signals including the time information from the positioning satellites.

10. An electronic timepiece comprising:

the device according to claim 1;

the communicator;

the one or more radio wave receivers;

the clock circuit; and a display configured to display the current time that is corrected based on the time information acquired.

11. The device according to claim 1, wherein a time required to acquire the time information by performing the first acquisition operation is shorter than a time required to acquire the time information by performing the second acquisition operation.

12. A method comprising:

acquiring time information by performing one or more of:

a first acquisition operation to control a communicator to communicate with an external device to receive signals including the time information; and a second acquisition operation to control one or more radio wave receivers, different from the communicator, to receive transmission radio waves with signals including the time information, wherein an amount of power consumption required to acquire the time information by performing the first acquisition operation is lower than an amount of power consumption required to acquire the time information by performing the second acquisition operation, and wherein performance of the first acquisition operation is prioritized over performance of the second acquisition operation such that the time information is acquired at least at a predetermined lower limit frequency; and performing a correction operation of correcting a current time counted by a clock circuit based on the time information acquired.

13. A computer-readable storage device storing instructions that cause one or more processors to at least:

acquire time information by performing one or more of:

a first acquisition operation to control a communicator to communicate with an external device to receive signals including the time information; and a second acquisition operation to control one or more radio wave receivers, different from the communicator, to receive transmission radio waves with signals including the time information, wherein an amount of power consumption required to acquire the time information by performing the first acquisition operation is lower than an amount of power consumption required to acquire the time information by performing the second acquisition operation, and wherein performance of the first acquisition operation is prioritized over performance of the second acquisition operation such that the time information is acquired at least at a predetermined lower limit frequency; and perform a correction operation of correcting a current time counted by a clock circuit based on the time information acquired.

14. The computer-readable storage device according to claim 13, wherein the instructions cause the one or more processors to:

perform the first acquisition operation during a first period;

determine whether the time information was acquired by the first acquisition operation during the first period; and in response to determining that the time information was not acquired by the first acquisition operation during the first period, perform the second acquisition operation on a predetermined schedule during a second period after the first period.

15. The computer-readable storage device according to claim 13, wherein the instructions cause the one or more processors to:

control the communicator to establish a communication connection with the external device in a first period;

determine whether the communication connection was established in the first period; and in response to determining that the communication connection was not established in the first period, perform the second acquisition operation on a predetermined schedule during a second period after the first period.

16. The computer-readable storage device according to claim 13, wherein the instructions cause the one or more processors to:

determine whether the time information was acquired by performing the first acquisition operation during a first period;

determine whether the time information was acquired at least once by performing the second acquisition operation during a second period following the first period; and in response to determining that the time information was acquired by performing the first acquisition operation during the first period and/or by performing the second acquisition operation during the second period, avoid performing the second acquisition operation again in a remaining time of the second period.

17. The computer-readable storage device according to claim 16, wherein the instructions cause the one or more processors to perform the second acquisition operation no more than a predetermined upper limit number of times.

18. The computer-readable storage device according to claim 16, wherein the length of the first period and the length of the second period are the same.

19. The computer-readable storage device according to claim 13, wherein the instructions cause the one or more processors to acquire the time information by performing the second acquisition operation to control one or more of:

a low-frequency radio wave receiver to receive the transmission radio waves in a low frequency band with the signals including the time information; and a satellite radio wave receiver to receive the transmission radio waves with the signals including the time information from positioning satellites.

20. The computer-readable storage device according to claim 19, wherein the instructions cause the one or more processors to:

in a first period, acquire the time information by performing the first acquisition operation;

determine whether the time information was acquired by performing the first acquisition operation;

in response to determining that the time information was not acquired by performing the first acquisition operation, in a second period after the first period, acquire the time information by performing the second acquisition operation to control the low-frequency radio wave receiver to receive the transmission radio waves in the low frequency band with the signals including the time information;

determine whether the time information was acquired by performing the second acquisition operation to control the low-frequency radio wave receiver to receive the transmission radio waves; and in response to determining that the time information was not acquired by performing the second acquisition operation to control the low-frequency radio wave receiver to receive the transmission radio waves, acquire the time information by performing the second acquisition operation to control the satellite radio wave receiver to receive the transmission radio waves with the signals including the time information from the positioning satellites.

21. The computer-readable storage device according to claim 19, wherein the instructions cause the one or more processors to:

in a first period, acquire the time information by performing the first acquisition operation;

determine whether the time information was acquired by performing the first acquisition operation; and in response to determining that the time information was not acquired by performing the first acquisition operation, in a second time period:

acquire a current location of the device;

determine whether the current location of the device is a location where the low-frequency radio wave receiver can receive the transmission radio waves in the low frequency band; and in response to determining that the current location of the device is not a location where the low-frequency radio wave receiver can receive the transmission radio waves in the low frequency band, acquire the time information by performing the second acquisition operation to control the satellite radio wave receiver to receive the transmission radio waves with the signals including the time information from the positioning satellites.

* * * * *